US006483249B2

(12) United States Patent
Ito et al.

(10) Patent No.: US 6,483,249 B2
(45) Date of Patent: Nov. 19, 2002

(54) PLANAR DISPLAY PANEL DRIVING METHOD

(75) Inventors: Atsushi Ito, Tokyo (JP); Hironobu Arimoto, Tokyo (JP); Hiroshi Ito, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/986,783

(22) Filed: Nov. 9, 2001

(65) Prior Publication Data

US 2002/0074951 A1 Jun. 20, 2002

Related U.S. Application Data

(62) Division of application No. 09/194,118, filed as application No. PCT/JP98/01444 on Mar. 30, 1998, now Pat. No. 6,323,596.

(30) Foreign Application Priority Data

Mar. 31, 1997 (JP) ..... 9-080540
Mar. 31, 1997 (JP) ..... 9-080541
Nov. 11, 1997 (JP) ..... 9-308829

(51) Int. Cl.[7] ..... H05B 37/00
(52) U.S. Cl. ..... 315/169.3; 315/169.4; 345/63
(58) Field of Search ..... 315/169.3, 169.4; 345/63, 68

(56) References Cited

U.S. PATENT DOCUMENTS 3,662,214 A 5/1972 Lustig
3,668,689 A 6/1972 Drage
4,140,945 A * 2/1979 Trogdon ..... 315/169.4
6,094,183 A 7/2000 Tanamachi et al.

FOREIGN PATENT DOCUMENTS

| | | |
|---|---|---|
| JP | 5857189 | 4/1983 |
| JP | 1131598 | 5/1989 |
| JP | 2219093 | 8/1990 |
| JP | 359928 | 3/1991 |
| JP | 3160488 | 7/1991 |
| JP | 447639 | 2/1992 |
| JP | 4274141 | 9/1992 |
| JP | 7295506 | 11/1995 |
| JP | 7319423 | 12/1995 |
| JP | 832904 | 2/1996 |
| JP | 955166 | 2/1997 |

* cited by examiner

*Primary Examiner*—David Vu
(74) *Attorney, Agent, or Firm*—Rothwell, Figg, Ernst & Manbeck PC

(57) ABSTRACT

A common electrode and an individual electrode are provided in plural pairs on a first transparent substrate, and recesses are formed in a second substrate in positions corresponding to the pairs of electrodes to define discharge cells of display cells. The display cells of a display panel can be individually driven on the cell-by-cell basis and the planar panel has a reduced thickness. A voltage pulse is applied to the individual electrode to reverse the polarity of wall charges accumulated on a dielectric layer, and a voltage pulse is then applied to the common electrode so that an electric field of the wall charges caused upon the reversal of the polarity is additionally applied. Thereby provided are a planar display panel which can set a large control margin in the display operation, ensure stable display, and present gradation display with high reliability and quality.

10 Claims, 29 Drawing Sheets

PATTERNING OF TRANSPARENT ELECTRODE (ETCHING)

FORMATION OF BUS ELECTRODES (Ag ELECTRODES) (SCREEN PRINTING)

SEALING(APPLICATION OF FRIT GLASS & HEAT-SEALING)

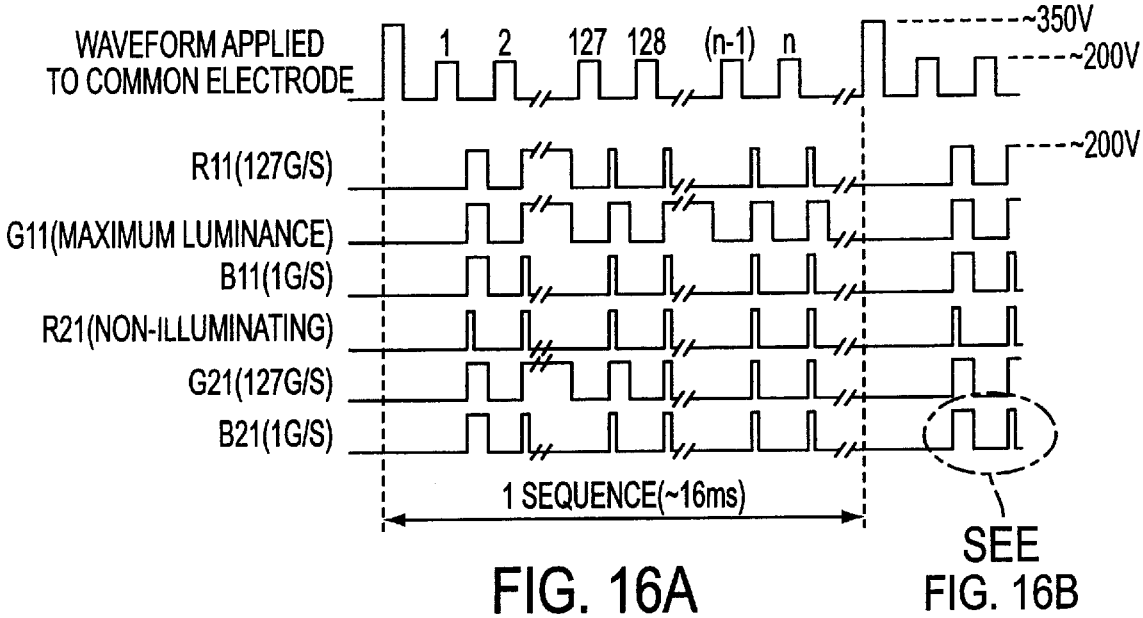
FIG. 16A
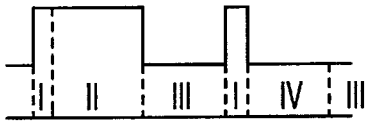
FIG. 16B
| | | I | II | III | IV |
|---|---|---|---|---|---|
| TOTAL DRIVING S/W | HIGH-SIDE S/W | ON | OFF | OFF | OFF |
| | LOW-SIDE S/W | OFF | OFF | ON | OFF |
| INDIVIDUAL DRIVING S/W | HIGH-SIDE S/W | OFF | ON | OFF | OFF |
| | LOW-SIDE S/W | OFF | OFF | OFF | ON |
FIG. 16C

V1, V2 : VOLTAGE VALUE APPLIED TO COMMON ELECTRODE
V1=V2 IN THE MEASUREMENT

V4 : BIAS VOLTAGE APPLIED TO INDIVIDUAL ELECTRODE
DISCHARGE LUMINESCENCE IS STOPPED
ON HIGH VOLTAGE SIDE

PLANAR DISPLAY PANEL DRIVING METHOD

CROSS-REFERENCE TO RELATED APPLICATIONS

This application is a divisional of U.S. patent application Ser. No. 09/194,118, filed Nov. 23, 1998, now U.S. Pat. No. 6,323,596, which is a §371 of PCT/JP98/01444, filed Mar. 30, 1998.

TECHNICAL FIELD

The present invention relates to a planar display panel which comprises a display panel having a two-dimensional screen to display characters, figures, images, etc. The present invention also relates to a manufacturing method, a controller, and a driving method for the planar display panel.

BACKGROUND ART

Hitherto, planar display panels of the type that a plurality of linear electrodes are arrayed in a matrix pattern in opposed relation with a dischargeable gas medium therebetween, and a voltage is applied to selected ones of the electrodes on both sides to develop gas discharge at the intersects of the both-side electrodes, have been disclosed in, e.g., Japanese Unexamined Patent Publication No. 3-160488 and No. 2-90192 and Japanese Unexamined Utility Model Publication No. 3-94751.

Those conventional planar display panels are constructed such that two insulating substrates each being light-transparent are bonded to each other to define a space, electrodes are provided on each of the substrates to form matrix-like discharge electrodes in the space and to position in opposed relation with the space between the electrodes on both sides, and partitions are provided to define a discharge space for each of the electrodes. Then, display control is performed by selecting desired ones of the matrix-like electrodes disposed in opposed relation. It has been therefore impossible to perform display control independently for each of display cells. Also, the above-mentioned structure has necessarily resulted in a large thickness of the planar display panel.

Another conventional planar panel utilizing gas discharge to effect display is described in Ohwaki and Yoshida, "Plasma Display", November 1983.

This panel is constructed by arranging comb-like electrodes coated with an insulating material, e.g., glass, such that the comb-like electrodes are opposed to each other in a matrix pattern with a discharge space between the electrodes on both sides. Display cells arrayed in units of a row or column are driven together by one comb-like electrode.

Display control of the panel is performed by three operations; i.e., a writing operation in which, of the comb-like electrodes in a row-and-column pattern, the comb-like electrodes on the scan side are driven successively while minute discharge is produced in a display cell locating between the selected comb-like electrode and the electrode opposed to it in the matrix pattern, a sustaining operation for selectively causing only those display cells, in which minute discharge is produced by the writing operation, to emit light over an entire display screen, and a total-writing/total-erasing operation for bringing the display cells into the same electrical condition over the entire display screen.

To display an image, it is required to control luminance for each of the display cells. Because each control and display electrode deals with many display cells at a time and the display cell operates with a binary characteristic (taking only two states of emitting light or not), a special method must be used to achieve gradation display. One driving method is disclosed in, e.g., Japanese Unexamined Patent Publication No. 6-186927.

According to the disclosed driving method, gradation display is achieved by dividing a display period into a plurality of periods having different sustaining periods (or different levels of luminance in sustaining periods) for the purpose of luminance representation, and performing operations of writing and sustaining display data in the respective divided periods, thereby combining the luminance levels in the divided periods with each other.

With the above conventional panel driving method, however, because the opposing matrix electrodes are used for control of display discharge, each electrode must control 100 ore more display cells at a time. Then, display is effected by time sequentially performing a writing step of driving scan electrodes in a group of matrix electrodes one by one, a sustaining step of alternately applying a sustaining voltage pulse to the group of matrix electrodes so that only those display cells, into which display data has been written, emit light for display, and a total-discharging/total-erasing step for making even electrical conditions of the cells effecting display and the cells not effecting display, respectively.

Further, in such a sequence control, the control process necessarily depends on characteristics of the display cells which are susceptible to large individual differences during the manufacturing steps, such as a voltage value to start discharge of each display cell, a minimum voltage value to sustain the discharge, and a writing voltage value for producing writing discharge. The voltage for sustaining the discharge, in particular, often has an allowable range of as narrow as 10 to 20 V because upper and lower limit values of the voltage are determined respectively by the discharge starting voltage and the minimum sustaining voltage.

For the above reasons, control margins for ensuring stable display cannot be set to large values, and the display sustaining voltage, the writing voltage, the discharge starting voltage, etc. need to be adjusted for each display panel. If those voltage values are fluctuated with the continued operation, they must be adjusted again. Another problem is that complicated characteristics of the display cells are subject to large fluctuations even in one sheet of display panel, and hence a production yield is reduced.

Further, in the above-described gradation control method for the conventional gas discharge panel, at least two operations of writing data and sustaining display need to be performed in the number of combinations enough to achieve gradation representation, and the writing operation takes at least 1 to 2 msec. Accordingly, the display sustaining period is discontinuous with the writing periods interleaved therein.

For the gradation representation, control is performed to finish in one sequence (about 16 ms: frame frequency 60 Hz). However, because luminance control cannot be performed continuously in point of time within one sequence, there occurs a mismatch between the gradation representation of display (gradation representation resulted from driving the panel as per design) and perception of luminance change by the human eyes. This raises a problem that discontinuous points in gradation, i.e., the so-called pseudo-contour, is perceived and quality of image display is greatly deteriorated.

The present invention has been accomplished in view of the state of art set forth above, and its object is to provide a planar display panel in which display cells of a display panel can be driven individually on the cell-by-cell basis, and a discharge space has a structure capable of reducing a thickness of the planar display panel, as well as a method for manufacturing the planar display panel.

Another object is to provide a controller for a planar display panel, with which switching control is performed for each of individual electrodes provided independently of one another in one-to-one relation to display cells of a planar display panel, in which the display cells can be individually driven on the cell-by-cell basis, thereby achieving gradation control.

Still another object is to provide a method for driving a planar display panel, which can perform control of sustaining discharge for a display panel having an electrode structure and a panel structure, which enable display cells to be driven individually on the cell-by-cell basis, regardless of discharge characteristics of the individual display cells, particularly a difference between a discharge starting voltage and a minimum discharge sustaining voltage, thereby providing a sufficiently large margin for discharge control, and which inserts an operation for stabilizing discharge at intervals of a predetermined period, thereby sustaining more stable discharge.

Still another object is to provide a method for driving a planar display panel, which performs discharge control in a continuous time range within one sequence, enabling display luminance to be represented in one continuous period, and hence can achieve gradation display suitable for image display.

DISCLOSURE OF THE INVENTION

A planar display panel according to the present invention comprises a first transparent substrate, a pair of electrodes provided on the first transparent substrate, and a second substrate having a recess formed in an area opposing to the pair of electrodes to define a discharge cell of a display cell. Therefore, a planar display panel is provided in which the display cells constituting the display panel can be driven individually on the cell-by-cell basis, and the discharge space has a structure capable of reducing the thickness of the planar panel.

Also, the pair of electrodes provided on the first transparent substrate is arrayed in plural number on the first transparent substrate in juxtaposed relation to form a group of electrodes. Therefore, an electrode pattern for the plurality of discharge cells can be formed with ease.

Further, the recess is rectangular in shape and has a desired depth. Therefore, the discharge space can be directly formed in the second substrate regardless of formation of the electrodes with no need of the barrier to demarcate the discharge space. The thickness of the planar display panel can be hence reduced.

The recess has a depth in the range of 300–600 $\mu$m. Therefore, the thickness of the discharge space is increased to provide higher luminance.

A dielectric layer is formed on the first transparent substrate to cover the pairs of electrodes provided. Therefore, electric charges are avoided from diffusing to the outside and can be enclosed in the discharge cells.

A fluorescent material layer is coated on a surface of the recess formed in the second substrate. Therefore, color display can be easily achieved with uniform luminance and hence uniformity of an image.

A reflecting layer is interposed between the bottom surface of the recess formed in the second substrate and the fluorescent material layer. Therefore, light emitted from the fluorescent material layer can be forced to exit forward efficiently.

The pair of electrodes comprise a common electrode provided on the first transparent substrate for driving all of display cells together, which constitute the display screen, or for partly driving any plural number of the display cells at a time, and one of individual electrodes provided on the first transparent substrate for individually driving the display cells on the cell-by-cell basis which constitute the display screen. Therefore, a planar display cell can be provided which has an electrode structure capable of individually driving the display cells of the display panel on the cell-by-cell basis and reducing the thickness of the planar panel.

The depth of the recess formed in the second substrate is set to be three or more times the gap formed between the common electrode and the individual electrode for each display cell to produce discharge. Therefore, the thickness of the discharge space is increased to provide higher luminance.

Evacuation grooves are formed to interconnect the display cells formed in the second substrate and an evacuation through hole is bored in the second substrate to be communicated with the evacuation grooves. Therefore, passages for purging impurity gas through them during evacuation to create a vacuum can be ensured.

Lead pins are vertically provided on the common electrode and the individual electrodes in positions on the first transparent substrate corresponding to between the display cells which constitute the display screen, and electrode leading-out through holes for leading out the lead pins to the back side of the display screen are bored in the second substrate in positions opposing to the lead pins. Therefore, the electrodes can be easily led out to the back side of the display screen.

The lead pins are fused to the bus electrodes of the individual electrodes and the common electrode by a paste or bonding material which is comprised primarily of the same metallic material as that of the bus electrodes of the individual electrodes and the common electrode. Therefore, the lead pins can be firmly fixed to the electrodes.

The lead pins each have a large-diameter base end portion which is fused to the electrode, and the electrode leading-out through holes each have a stepped shape comprising a large-diameter portion in which the base end portion of the lead pin is inserted, and a small-diameter portion through which a distal end portion of the lead pin is extended. It is therefore possible to properly position the lead pin with ease and to prevent a useless gap from being caused between the first and second glass substrates.

A sealing guard is provided near a portion where the lead pins are fused, so that a sealing material is prevented from flowing into the display cells when an assembly of the first and second glass substrates is sealed off. Therefore, a sealing material can be surely prevented from flowing into the display cells.

Further, a method for manufacturing a planar display panel according to the present invention comprises the steps of patterning transparent electrodes of the individual electrodes on the first transparent substrate, forming the bus electrodes of the individual electrodes and the common electrode on the first transparent substrate with the transparent electrodes formed thereon, forming a dielectric layer to cover the individual electrodes and the common electrode on the first transparent substrate, vertically fixing the lead pins to the individual electrodes and the common electrode through the electrode leading-out windows formed in the dielectric layer, forming a protective film on the first transparent substrate having been subjected to the pin fixing step, forming, in the second substrate, the recesses for defining the discharge spaces of the display cells which constitute the display screen, the electrode leading-out through holes for leading out the lead pins, which are vertically fixed to the common electrode and the individual electrodes, to the back side of the display screen, and the evacuation through hole, forming the fluorescent material layers on the bottom surfaces of the recesses defining the display cells, fitting the first and second substrates fabricated through the above steps to assemble a panel such that the lead pins on the first transparent substrate are extended to the outside via the through holes of the second substrate, and sealing the assembled panel of the first and second substrates. It is therefore possible to easily manufacture a planar display panel which has an electrode structure capable of individually driving the display cells of the display panel on the cell-by-cell basis and reducing the thickness of the planar panel.

Moreover, according to the present invention, in a controller for a planar display panel comprising a common electrode for driving all of display cells together, which constitute a display screen, or for partly driving any plural number of the display cells at a time, and individual electrodes for individually driving the display cells on the cell-by-cell basis, the controller includes a driving circuit for changing luminance in accordance with the number of pulses applied to each of the individual electrodes within a unit time, thereby effecting gradation display. It is therefore possible to achieve gradation control with switching control performed for each of the individual electrodes provided independently of one another in one-to-one one relation to the display cells.

The driving circuit effects the gradation display based on control of application of a relatively wide sustaining pulse and a relatively narrow extinguishing pulse which are used as the pulses to be applied to each of the individual electrodes within the unit time. Therefore, discharge display can be stopped during a period in which the extinguishing pulse is applied, and hence the gradation display can be achieved as desired.

In addition, the planar display panel is constituted by display modules as constituent elements each comprising a plurality of display units combined into a pattern of row-and-column matrix, the display modules arranged in the horizontal direction are cascaded, and a power supply is connected to the display modules in parallel. A signal processing circuit for applying control signals to driving circuits of each of the display module comprises an address information storage unit for storing specific address information, an input signal control unit for allowing input data to pass through it and taking data, which the display module including that control unit is to represent by itself, out of a position indicated by the specific address and a display effective signal in the data, a through data output buffer for outputting the data, which has passed through the input signal control unit, to the adjacent display module cascaded downstream, a memory into which the data taken out of the input signal control unit is written in response to a write control signal, and from which the data is read in response to a red control signal, a display pulse generator for generating common electrode and individual electrode driving pulses based on the data taken out of the input signal control unit, a counter for counting the common electrode driving pulse output from the display pulse generator, a look-up table for converting the number of pulses counted by the counter into a numerical value of gradation data, a display data generator for outputting individual electrode control data based on comparison between the gradation data from the look-up table and the individual electrode driving display data read from the memory, and an output buffer for outputting signals of the display pulse generator and the display data generator to the individual electrode driving circuits and the common electrode driving circuits. Therefore, when data control is performed for the plurality of display modules combined with each other, individual control of the respective display modules in accordance with the display data can be achieved by taking in the display data corresponding to the address of each display module. a common electrode driven in common and an individual electrodes driven individually are provided side by side for each of a plurality of cells, and a voltage pulse is applied to the common electrode to produce luminescence due to discharge on a dielectric layer formed over the common electrode and the individual electrode, the method comprises the steps of applying a voltage pulse to the individual electrode to reverse the polarity of wall charges accumulated on the dielectric layer, and then applying a voltage pulse to the common electrode so that an electric field of the wall charges caused upon the reversal of the polarity is additionally applied. With this feature, discharge produced by applying one composite voltage pulse to the common electrode functions to not only start the discharge, but also initialize the display cell with erase discharge, and therefore a large control margin can be set for the display operation. Further, by applying display initializing pulses to all the individual electrodes at constant intervals, even when discharge produced upon driving of the common electrode becomes unstable, display can be maintained in a stable state, thus resulting in very stable display.

Also, assuming that one sequence is defined by a certain number of voltage pulses applied to the common electrode, the voltage pulse is applied to the individual electrode in units of one or plural sequences.

The voltage pulse applied to the common electrode functions to start discharge at rising of the voltage pulse as a result of addition of the electric field of the wall charges caused upon the reversal of the polarity, and to produce erase discharge at falling of the voltage pulse with wall charges caused by the started discharge.

The voltage pulse applied to the common electrode is a composite voltage pulse comprising a first voltage pulse not higher than the discharge starting voltage and a second voltage pulse superposed within a period of the first voltage pulse, the composite voltage pulse having a voltage value not less than the discharge starting voltage.

Erase discharge is produced due to the wall charges at falling of the first voltage pulse.

The method for driving a planar display panel may further comprise the step of applying the voltage pulse to the individual electrode to stop the discharge after erase discharge has been produced by the composite voltage pulse applied to the common electrode.

When the voltage pulse is applied to the common electrode to produce discharge, a voltage in a discharge sustaining region is applied to the individual electrode of the display cell in which the discharge is to be sustained, and a voltage in a discharge suppression region is applied to the individual electrode of the display cell in which the discharge is to be stopped. With this feature, the common electrode has a function of sustaining discharge, all the display cells can be driven at a time, and display control can be performed by driving the individual electrodes at a lower frequency. Therefore, the circuit configuration is simplified. In other words, circuits requiring large power can be concentrated on a section for driving the common electrode, while the individual electrodes can be driven by circuits operating at a lower voltage and consuming less power. As a result, an inexpensive and highly-reliable planar display panel can be manufactured.

Assuming that one sequence is defined by a certain number of voltage pulses applied to the common electrode, gradation display is made by applying a voltage in a discharge sustaining region enough to sustain the discharge to the individual electrode corresponding to the number of voltage pulses in one part of one sequence, thereby providing a display sustaining period, and by applying a voltage in a discharge suppression region to stop the discharge to the individual electrode corresponding to the number of voltage pulses in the other part of one sequence, thereby providing a display suppression period. With this feature, gradation display is realized by setting a continuous display period in one sequence, whereby gradation display having high quality and suitable for image representation can be achieved.

The front half of one sequence provides the display sustaining period and the second half of one sequence provides the display suppression period.

The certain number of voltage pulses applied to the common electrode within one sequence is selected to be not less than the number of gradation steps, and a plural number of voltage pulses are assigned to one gradation step.

BRIEF DESCRIPTION OF THE DRAWINGS

FIG. 16A is a chart of driving waveforms applied to electrodes for display in luminance gradation by the driving circuit of FIG. 14, FIG. 16B is an enlarged view of the circled part of FIG. 16A, and FIG. 16C is an explanatory view for the waveforms.

BEST MODE FOR CARRYING OUT THE INVENTION

Embodiment 1

Figure 1:
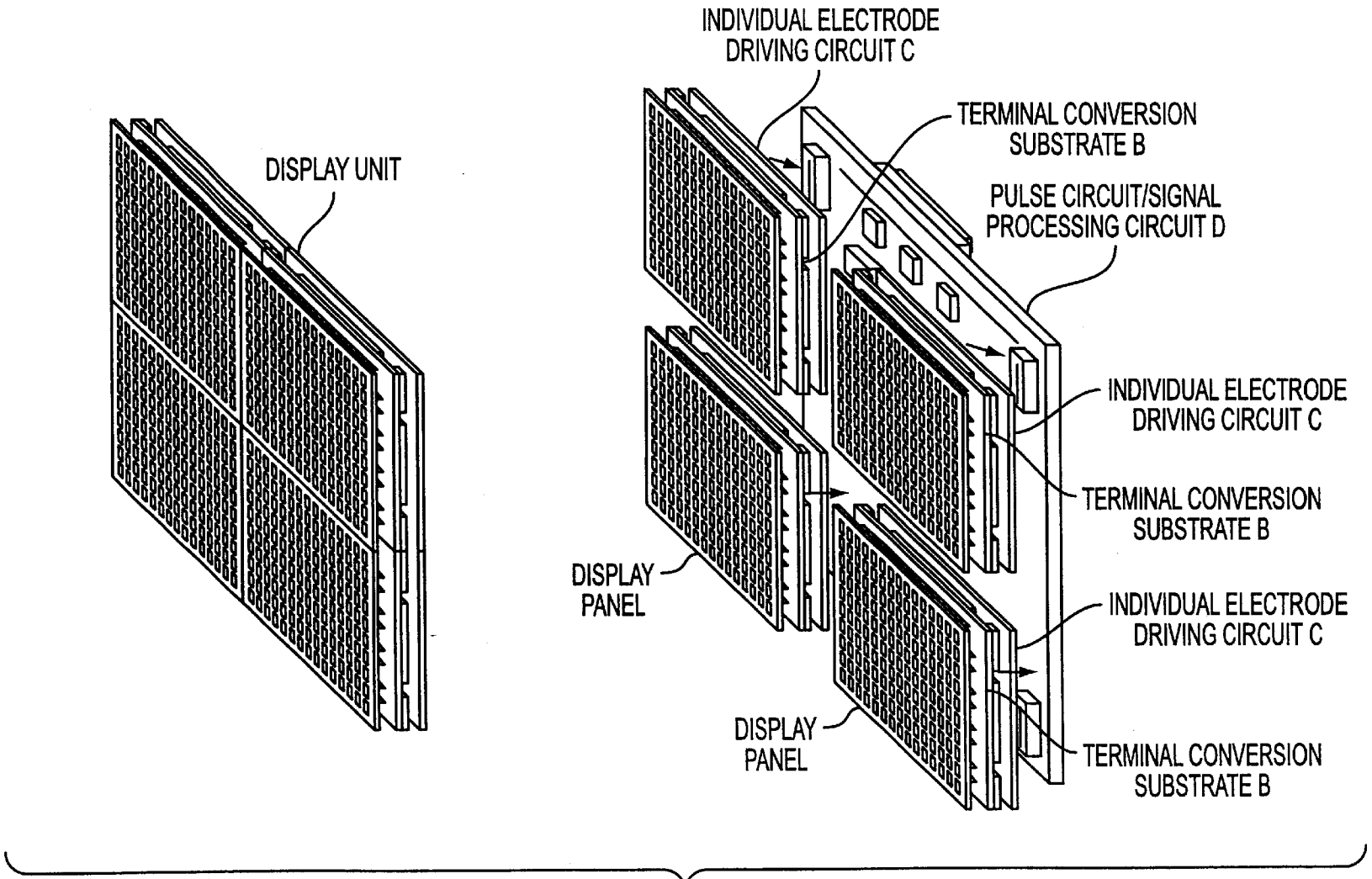
FIG. 1 is a schematic view showing an entire construction of a planar display panel according to Embodiment 1 of the present invention.

FIG. 1 is a schematic view showing an entire construction of a planar display panel according to Embodiment 1 of the present invention.

As shown in FIG. 1, a color flat panel constituting a planar display panel according to this embodiment comprises display panels each of which has a display section and a driving section combined into an integral unit, and hence is easy to handle. A display unit of 256 dots, as a standard unit, is made up of four display panels A each comprised of 64 dots. A terminal conversion board B and an individual electrode driving circuit D are provided on the back side of each display panel. A pulse circuit/signal processing circuit D is provided in common for the four display panels A.

Figure 2A:
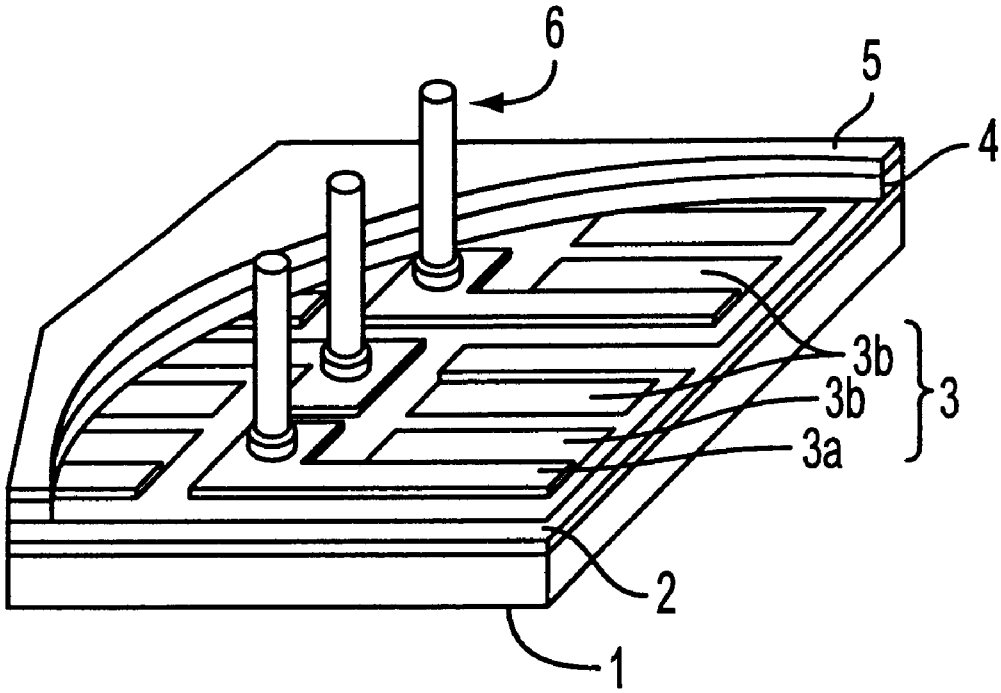
FIGS. 2A and 2B are partial perspective views showing a construction on a front glass substrate, as a first transparent substrate, which constitutes the display panel according to Embodiment 1 of the present invention.
Figure 2B:
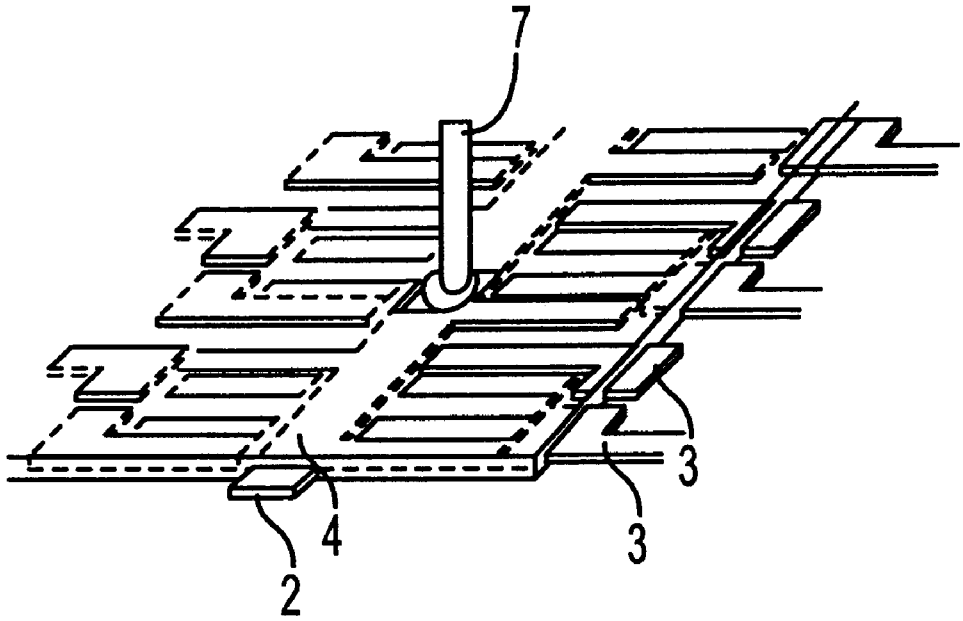
Figure 3:
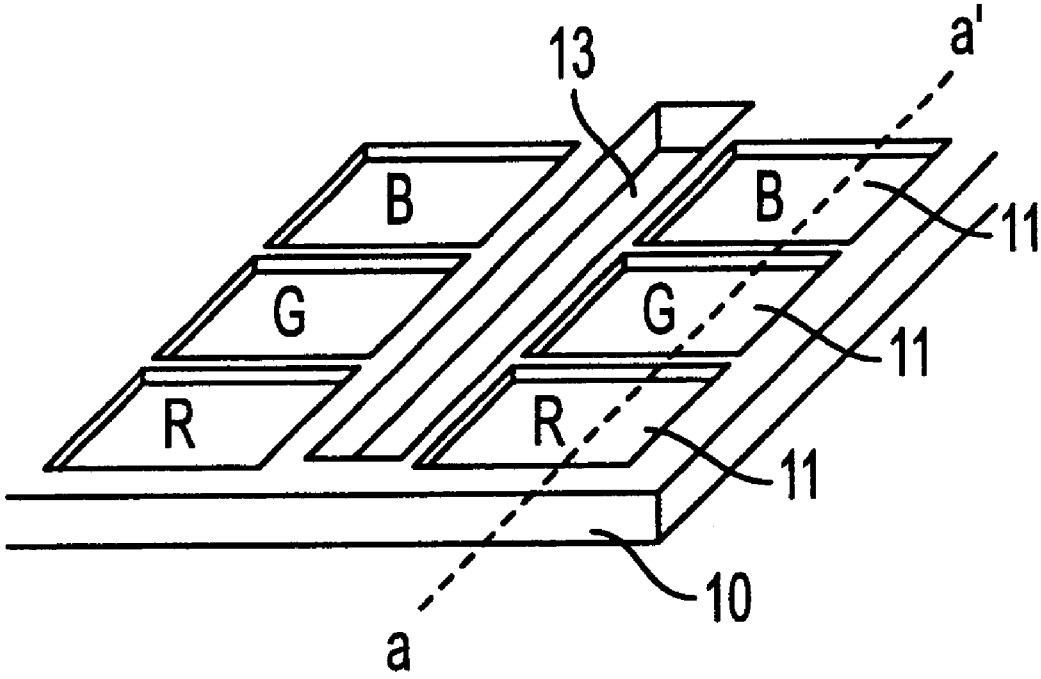
FIG. 3 is a partial perspective view showing a construction on a back glass substrate, as a second substrate, which constitutes the display panel according to Embodiment 1 of the present invention.
Figure 4:
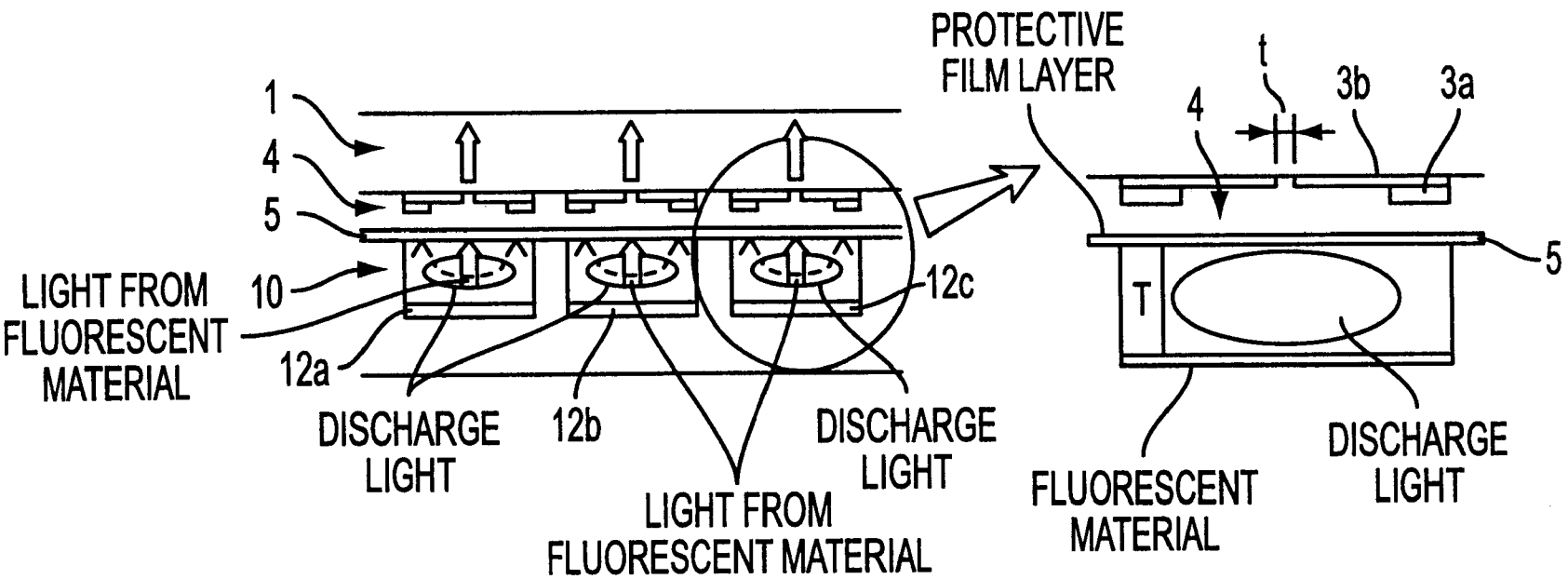
FIG. 4 is a sectional view taken along line a–a' in FIG. 3.
Figure 5:
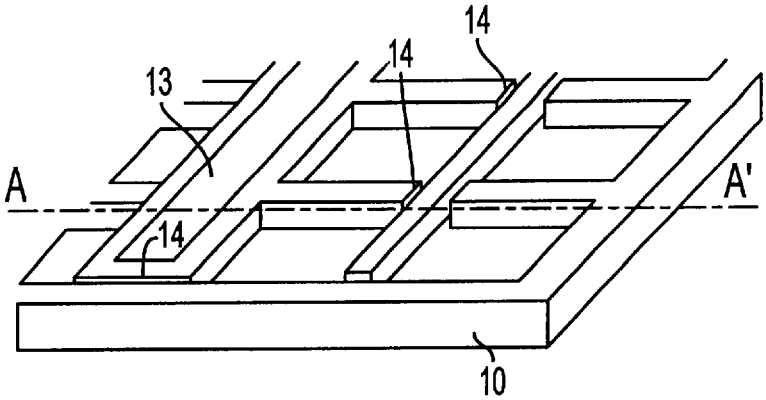
FIG. 5 is a structural view showing evacuation grooves on the back glass substrate.

FIGS. 2 and 3 are partial perspective views showing respectively a construction on a front glass substrate as a first transparent substrate and a construction on a back glass substrate as a second substrate, which constitute the display panel. FIG. 4 is a sectional view taken along line a–a' in FIG. 3, and FIG. 5 is a structural view showing evacuation grooves on the back glass substrate.

As shown in FIG. 2A, on one side of the front glass substrate 1, a pair of electrodes are provided in plural number in juxtaposed relation to form a group of electrodes, each pair comprising a common electrode 2 for driving all of display cells together, which constitute a display screen, or for partly driving any plural number of the display cells at a time, and one of individual electrodes 3 for individually driving the display cells on the cell-by-cell basis which constitute the display screen.

A dielectric layer 4 and a protective film layer 5 are formed to cover the pairs of electrodes. An electrode leading-out lead pin 6 is vertically provided on each of the individual electrodes 3 in a position corresponding to between the display cells which constitute the display screen. Reference numeral 3*b* denotes a transparent electrode connected to a bus electrode 3*a* of the corresponding either individual electrode 3 or the common electrode 2.

Also, as shown in FIG. 2B, on one side of the front glass substrate 1, an electrode leading-out lead pin 7 is vertically provided on the common electrode 2 in a position corresponding to between the display cells similarly to the lead pin 6 for the individual electrode 3. The lead pins 6, 7 are fused to the common electrode 2 and the bus electrode 3*a* of the individual electrode 3 by a paste or blazing material which is comprised. primarily of the same metallic material as that of the common electrode 2 and the individual electrode 3. Note that, in FIG. 2B which shows the vicinity of a portion where the lead pin for the common electrode 2 it taken out, broken lines represent electrode patterns underlying the dielectric layer 4.

On the other hand, as shown in FIGS. 3 and 4, rectangular recesses 11 having a desired depth are formed in areas of the back glass substrate 10 opposing to the common electrode 2 and the individual electrodes 3, which are provided on the front glass substrate 1, thus defining discharge spaces for the display cells. Fluorescent material layers 12*a*, 12*b*, 12*c* in red, green and blue are coated on bottom surfaces of the corresponding recesses 11 with reflecting surfaces (not shown) of white glass or metal interposed therebetween. Further, electrode leading-out through holes 13 for leading out the leads pins 6 and 7 to the back side of the display screen are bored in the back glass substrate 10 in positions corresponding to the leads pins 6 and 7.

While the gap t formed between the common electrode and the individual electrode for each display cell to produce discharge is usually 100 $\mu$m, the recess 11 has a depth T being three or more times the gap t, i.e., about 300–600 $\mu$m. In other words, the thickness of the discharge space is increased to provide higher luminance.

As shown in FIG. 5, evacuation grooves 14 are provided to interconnect the discharge spaces for the display cells which are defined by the recesses 11 formed in the back glass substrate 10. The evacuation grooves 14 are communicated with an evacuation through hole (described later) which is bored in the back glass substrate, thereby ensuring passages through which impurity gas is purged during evacuation to create a vacuum.

Figure 6:
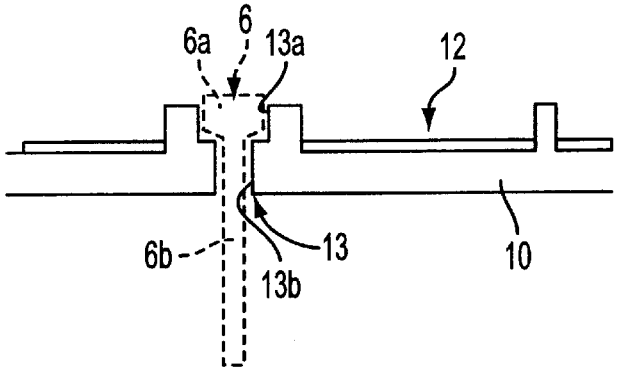
FIG. 6 is an explanatory view for explaining shapes of a lead pin 6 and a through hole 13 for leading out an electrode.

The display panel is assembled by fitting the front glass substrate 1 and the back glass substrate 10, constructed as described above, to each other such that the lead pins vertically provided on the front glass substrate 1 are extended to the outside via the through holes of the back glass substrate 10, and then by sealing the assembled panel. In this respect, as shown in FIG. 6, the lead pin 6 is formed to have a base end portion 6*a* which is fused to the electrode, and a slender distal end portion 6*b*, the base end portion 6*a* having a larger diameter than the distal end portion 6*b*. The electrode leading-out through hole 13 is formed into a stepped shape comprising a large-diameter portion 13*a* in which the base end portion 6*a* of the lead pin 6 is inserted, and a small-diameter portion 13*b* through which the distal end portion 6*b* of the lead pin 6 is extended. This structure is effective in positioning the lead pin 6 properly and preventing a useless gap from being caused between the front glass substrate 1 and the back glass substrate 10. The lead pin 7 is also formed to have a similar shape as the lead pin 6.

Figure 7:
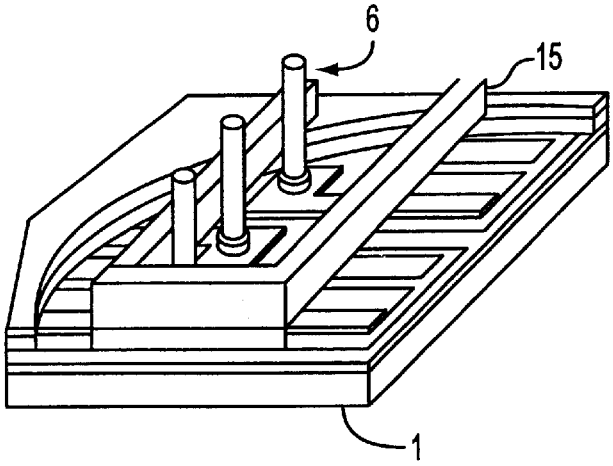
FIG. 7 is an explanatory view of a sealing guard 15 provided near a portion where the lead pins 6 are fused to the front glass substrate 1.

Further, as shown in FIG. 7, a sealing guard 15 is provided near a portion where the lead pins 6 are fused to the front glass substrate 1, so that a sealing material is prevented from flowing into the display cells when the assembly of the front glass substrate 1 and the back glass substrate 10 is sealed off.

A method for manufacturing the planar display panel having the above-described construction with be described below.

FIGS. 8 to 11 show successive manufacturing steps of the planar display panel in which; FIGS. 8 and 9 show successive manufacturing steps of the front glass substrate 1, FIG. 10 shows successive manufacturing steps of the back glass substrate 10, and FIG. 11 shows final steps of fitting the front glass substrate 1 and the back glass substrate 10 for assembly and sealing of the display panel.

The manufacturing steps of the front glass substrate 1 is explained with reference to FIGS. 8 and 9.

Figure 8A:
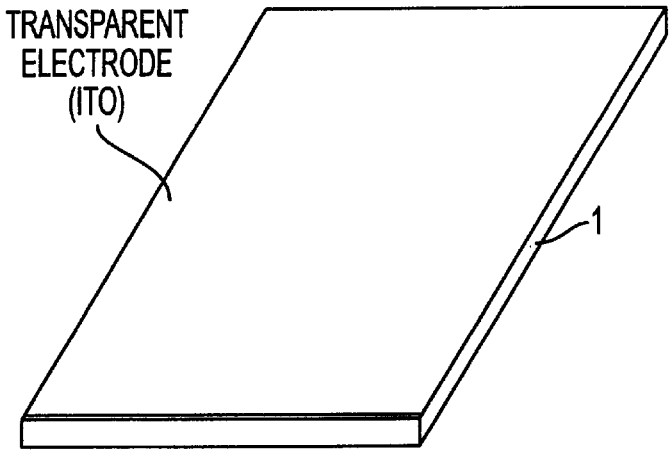
FIGS. 8A, 8B and 8C are a set of views showing successive manufacturing steps of the front glass substrate 1.
Figure 8B:
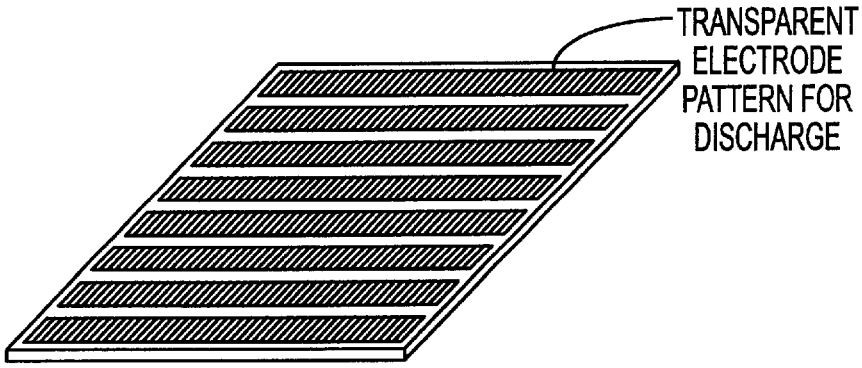

First, as shown in FIG. 8A, the front glass substrate 1 having a transparent electrode for the individual electrodes formed all over one surface thereof is subfected to an etching step for patterning of the transparent electrode. A transparent electrode pattern is thus formed as shown in FIG. 8B.

Figure 8C:
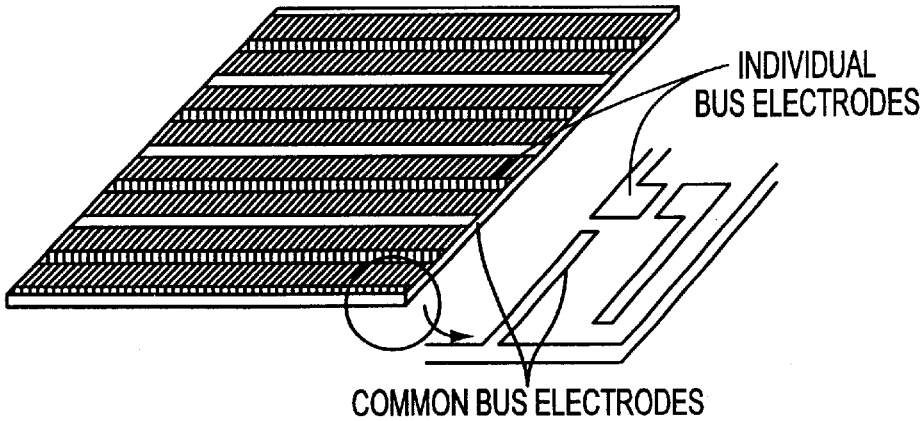

Then, as shown in FIG. 8C, the bus electrodes of the individual electrodes 3 and the common electrode 2 are formed by screen printing.

Figure 9A:
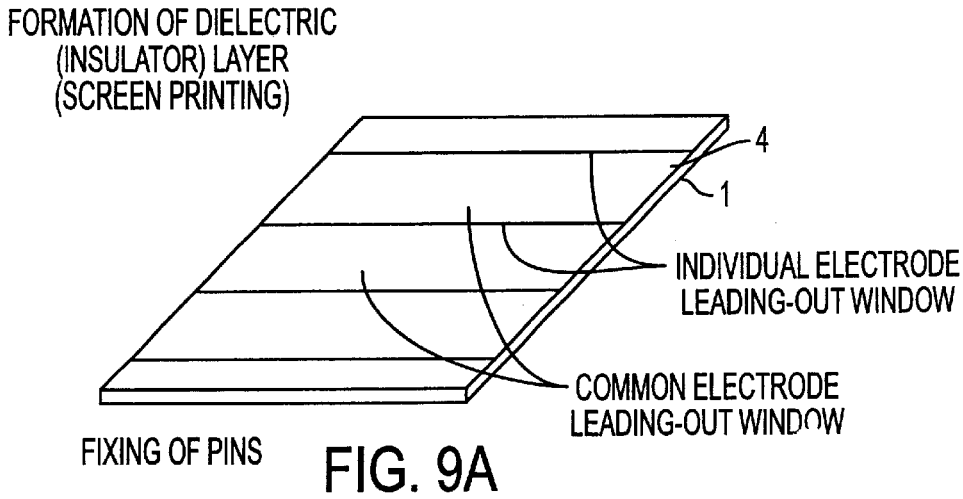
FIGS. 9A and 9B are a set of views showing successive manufacturing steps subsequent to FIGS. 8A, 8B and 8C.

Subsequently, as shown in FIG. 9A, the dielectric layer 4 made of an insulator and having windows for leading out the common electrode 2 and the individual electrodes 3 is formed by screen printing to cover the common electrode 2 and the individual electrodes 3.

Figure 9B:
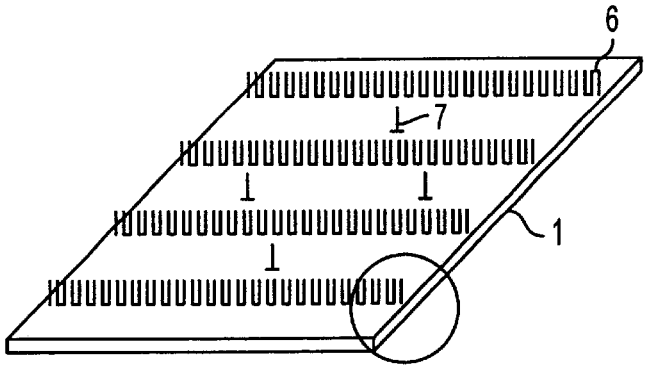
Figure 9C:
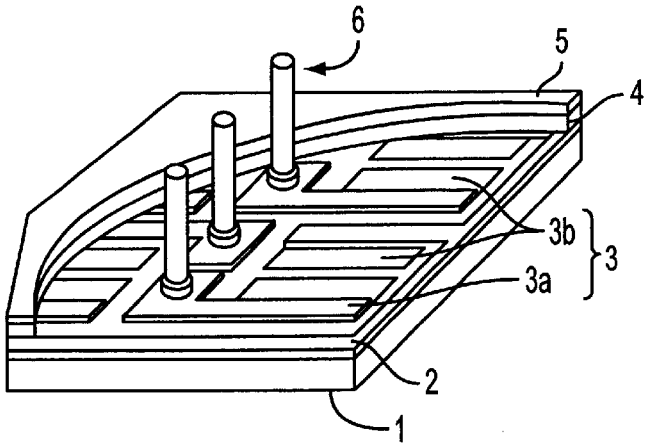
FIG. 9C is an enlarged view of the circled portion in FIG. 9B, FIGS. 10A, 10B and 10C are a set of views showing successive manufacturing steps of the back glass substrate 10.

After that, as shown in FIGS. 9B and 9C, the lead pins 6 and 7 are vertically fixed onto the common electrode 2 and the individual electrodes 3 through the electrode leading-out windows, followed by forming the protective film 5 by vacuum deposition.

Figure 10A:
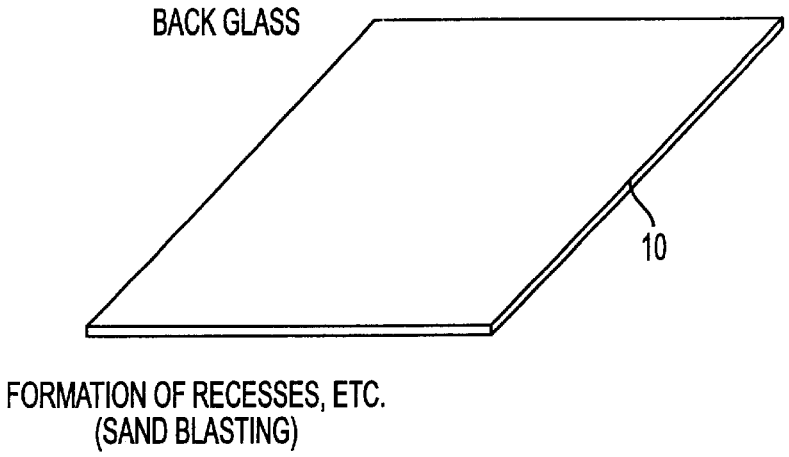
Figure 10B:
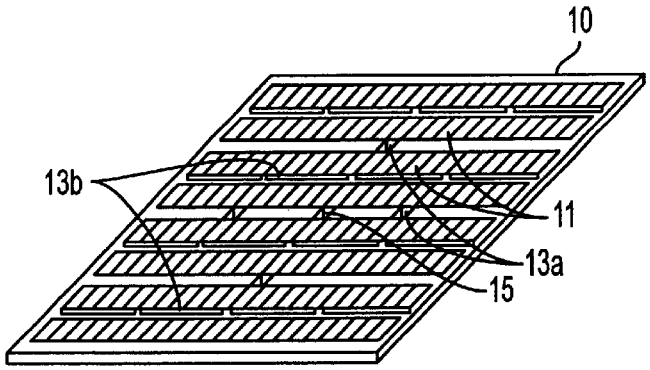

First, the back glass substrate 10 shown in FIG. 10A is subjected to sand blasting to form recesses 11 defining the discharge spaces for the display cells which constitute the display screen on the back glass substrate, the electrode leading-out through holes 13*a*, 13*b* for leading out the lead pins 7, 6, respectively which are vertically fixed onto the common electrode 2 and the individual electrodes 3, to the back side of display screen, and the evacuation through holes 15 communicated with the evacuation grooves 14, as shown in FIG. 10B.

Figure 10C:
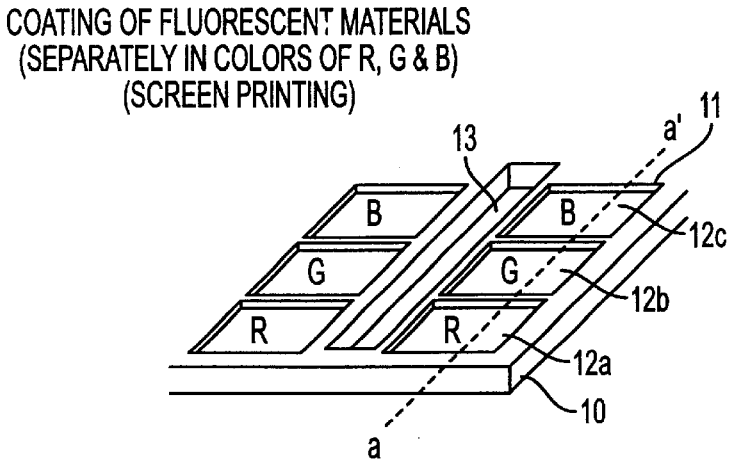

Then, as shown in FIG. 10C, the fluorescent material layers 12*a*, 12*b*, 12*c* in red, green and blue are coated by screen printing on the bottom surfaces of the recesses 11 forming the display cells with reflecting surfaces (not shown) of white glass or metal interposed therebetween.

Figure 11A:
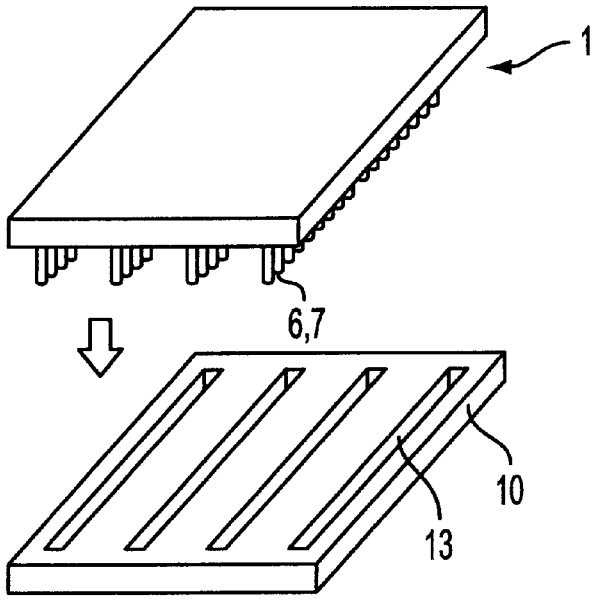
FIGS. 11A, 11B and 11C are a set of views showing final steps of fitting the front glass substrate 1 and the back glass substrate 10 for assembly and sealing of the display panel.
Figure 11B:
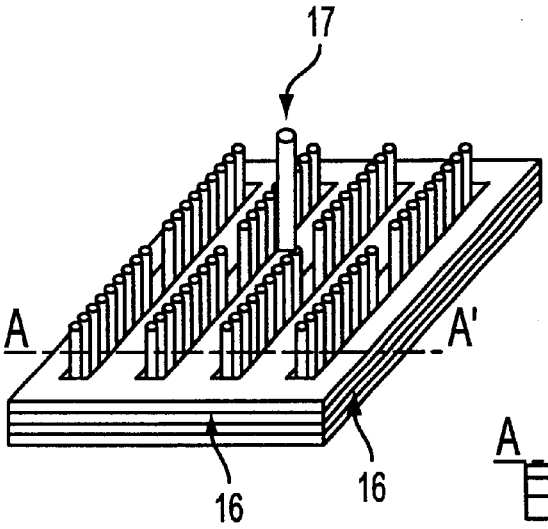
Figure 11C:
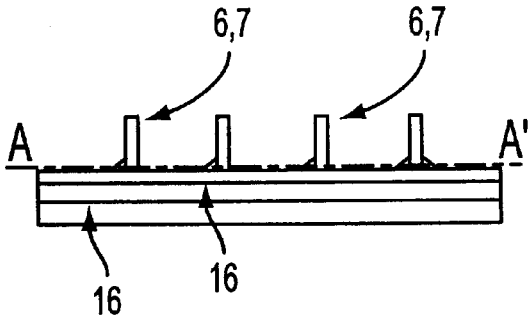

Next, as shown in FIG. 11A, the display panel is assembled by fitting the front glass substrate 1 and the back glass substrate 10, constructed as described above, to each other such that the lead pins 6 and 7 on the front glass substrate 1 are extended to the outside via the through holes 13 of the back glass substrate 10. Frit glass is applied to the assembled substrates to form sealing layers 16, as shown in FIGS. 11B and 11C, thereby completing the sealed display panel. Incidentally, 17 denotes an evacuation glass tube.

With the above-described Embodiment 1, therefore, since the planar display panel comprises a first transparent substrate, a pair of electrodes provided on the first transparent substrate, and a second substrate having a recess formed in an area opposing to the pair of electrodes to define a discharge cell of each display cell, it is possible to provide a planar display panel in which the display cells constituting the display panel can be driven individually on the cell-by-cell basis, and the discharge space has a structure capable of reducing the thickness of the planar panel.

Also, since the pair of electrodes provided on the first transparent substrate is arrayed in plural number on the first transparent substrate in juxtaposed relation to form a group of electrodes, an electrode pattern for the plurality of discharge cells can be formed with ease.

Since the recess is rectangular in shape and has a desired depth, the discharge space can be directly formed in the second substrate regardless of formation of the electrodes with no need of the barrier to demarcate the discharge space. The thickness of the planar display panel can be hence reduced.

Since the recess has a depth in the range of 300–600 $\mu$m, the thickness of the discharge space is increased to provide higher luminance.

Since a dielectric layer is formed on the first transparent substrate to cover the pairs of electrodes provided, electric charges are avoided from diffusing to the outside and can be enclosed in the discharge cells.

Since a fluorescent material layer is coated on the bottom surface of the recess formed in the second substrate, color display can be easily achieved with uniform luminance and hence uniformity of an image.

Since a reflecting layer is interposed between the bottom surface of the recess formed in the second substrate and the fluorescent material layer, light emitted from the fluorescent material layer can be forced to exit forward efficiently.

Since each pair of electrodes comprise a common electrode are provided on the first transparent substrate for driving all of display cells together, which constitute the display screen, or for partly driving any plural number of the display cells at a time, and one of individual electrodes provided on the first transparent substrate for individually driving the display cells on the cell-by-cell basis which constitute the display screen, a planar display cell can be provided which has an electrode structure capable of individually driving the display cells of the display panel on the cell-by-cell basis, and reducing the thickness of the planar panel.

Since the depth of the recess formed in the second substrate is set to be three or more times the gap formed between the common electrode and the individual electrode for each display cell to produce discharge, the thickness of the discharge space is increased to provide higher luminance.

Since evacuation grooves are formed to interconnect the display cells formed in the second substrate and an evacuation through hole is bored in the second substrate to be communicated with the evacuation grooves, passages for purging impurity gas through them during evacuation to create a vacuum can be ensured.

Since lead pins are vertically provided on the common electrode and the individual electrodes in positions on the first transparent substrate corresponding to between the display cells which constitute the display screen, and electrode leading-out through holes for leading out the lead pins to the back side of the display screen are bored in the second substrate in positions opposing to the lead pins, the electrodes can be easily led out to the back side of the display screen.

Since the lead pins are fused to the bus electrodes of the individual electrodes and the common electrode by a paste or bonding material which is comprised primarily of the same metallic material as that of the bus electrodes of the individual electrodes and the common electrode, the lead pins can be firmly fixed to the electrodes.

Since the lead pins each have a large-diameter base end portion which is fused to the electrode, and the electrode leading-out through holes each have a stepped shape comprising a large-diameter portion in which the base end portion of the lead pin is inserted, and a small-diameter portion through which a distal end portion of the lead pin is extended, it is possible to properly position the lead pin with ease and to prevent a useless gap from being caused between the first and second glass substrates.

Since a sealing guard is provided near a portion where the lead pins are fused, a sealing material can be prevented from flowing into the display cells when the assembly of the first and second glass substrates is sealed off.

Further, with the above-described Embodiment 1, the method for manufacturing the planar display panel comprises the steps of patterning transparent electrodes of the individual electrodes on the first transparent substrate, forming the bus electrodes of the individual electrodes and the common electrode on the first transparent substrate with the transparent electrodes formed thereon, forming a dielectric layer to cover the individual electrodes and the common electrode on the first transparent substrate, vertically fixing the lead pins to the individual electrodes and the common electrode through the electrode leading-out windows formed in the dielectric layer, forming a protective film on the first transparent substrate having been subjected to the pin fixing step, forming, in the second substrate, the recesses for defining the discharge spaces of the display cells which constitute the display screen, the electrode leading-out through holes for leading out the lead pins, which are vertically fixed to the common electrode and the individual electrodes, to the back side of the display screen, and the evacuation through hole, forming the fluorescent material layers on the bottom surfaces of the recesses defining the display cells, fitting the first and second substrates fabricated through the above steps to assemble a panel such that the lead pins on the first transparent substrate are extended to the outside via the through holes of the second substrate, and sealing the assembled panel of the first and second substrates. It is therefore possible to easily manufacture a planar display panel which has an electrode structure capable of individually driving the display cells of the display panel on the cell-by-cell basis and reducing the thickness of the planar panel.

Embodiment 2

This Embodiment 2 concerns with a controller for driving and controlling the planar display panel having the inventive electrode structure, as obtained with the above-described Embodiment 1, wherein the display panel is assembled by fitting the front glass substrate 1 and the back glass substrate 10 to each other such that the lead pins 6 and 7 on the front glass substrate 1 are extended to the outside via the through holes 13 of the back glass substrate 10, and frit glass is applied to the assembled substrates to form sealing layers, thereby completing the planar display panel which has an electrode structure capable of individually driving the display cells of the display panel on the cell-by-cell basis and reducing the thickness of the planar panel. The controller for driving and controlling the planar display panel will be described below.

Figure 12:
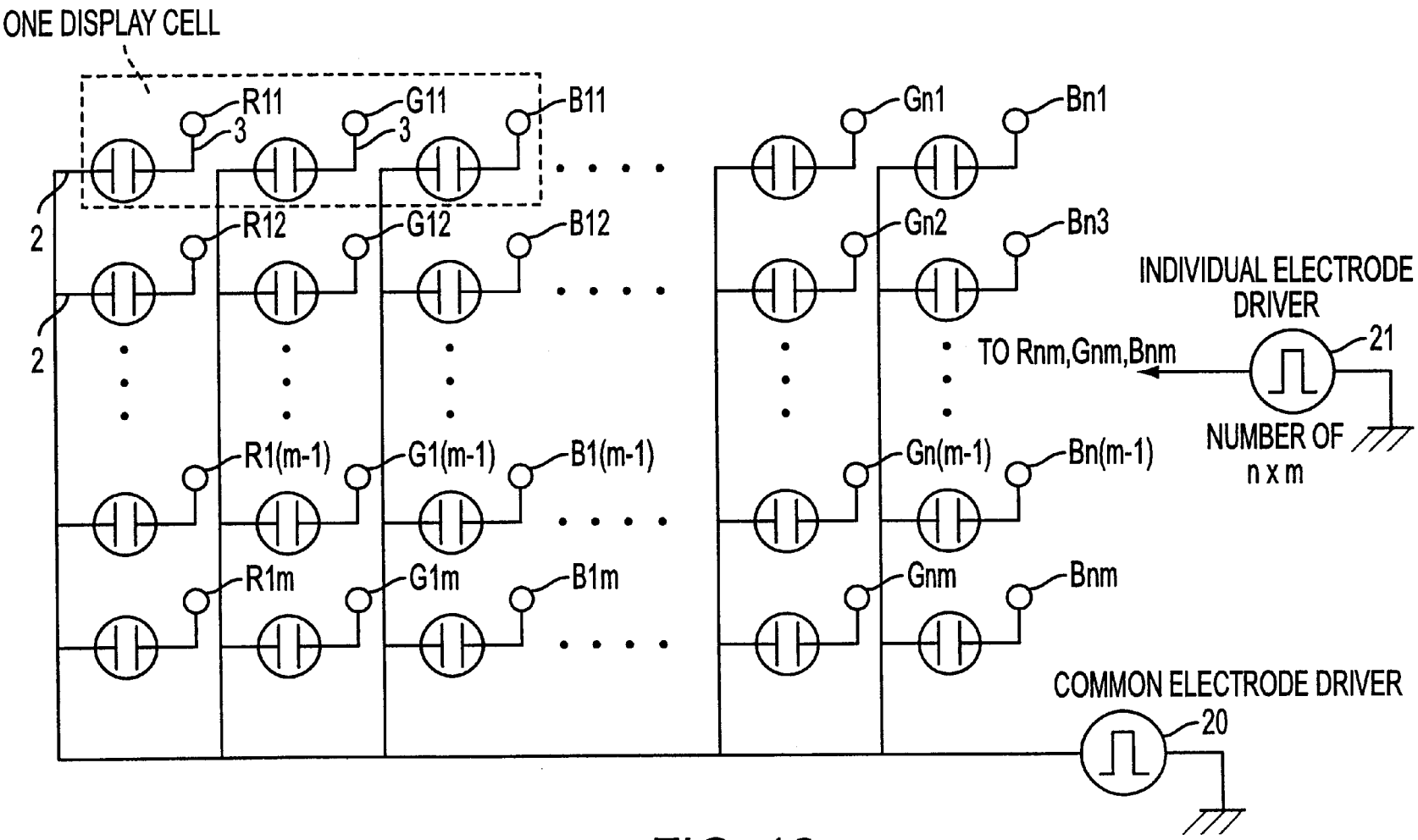
FIG. 12 is an equivalent circuit diagram of the display panel, in which display cells are each represented by a discharge tube, for explaining a controller for the planar display panel according to Embodiment 2 of the present invention.

FIG. 12 is an equivalent circuit diagram of the planar display panel in which the display cells are each represented by a discharge tube.

As shown in FIG. 12, the planar display panel comprises a plurality of display cells corresponding to pixels in one-to-one relation, each display cell consisting of three cell units coated with fluorescent material layers in red, green and blue. The common electrode 2 for the respective cells is supplied with a pulse having the same driving waveform from a common electrode driver 20, and individual electrodes Rnm, Gnm, Bnm (n, m; natural numbers), which constitute the individual electrodes 3, are supplied with pulses having different driving waveforms from an individual electrode driver 21.

In the case of driving one display panel together at a time, one common electrode is used drive all the cells by the same driving waveform. In the case of dividing one display panel into a plurality of blocks, a plurality of common electrode are used to drive the blocks respectively by the same driving waveform or driving waveforms resulted from shifting the phase of a display driver for each of the blocks.

Figure 13:
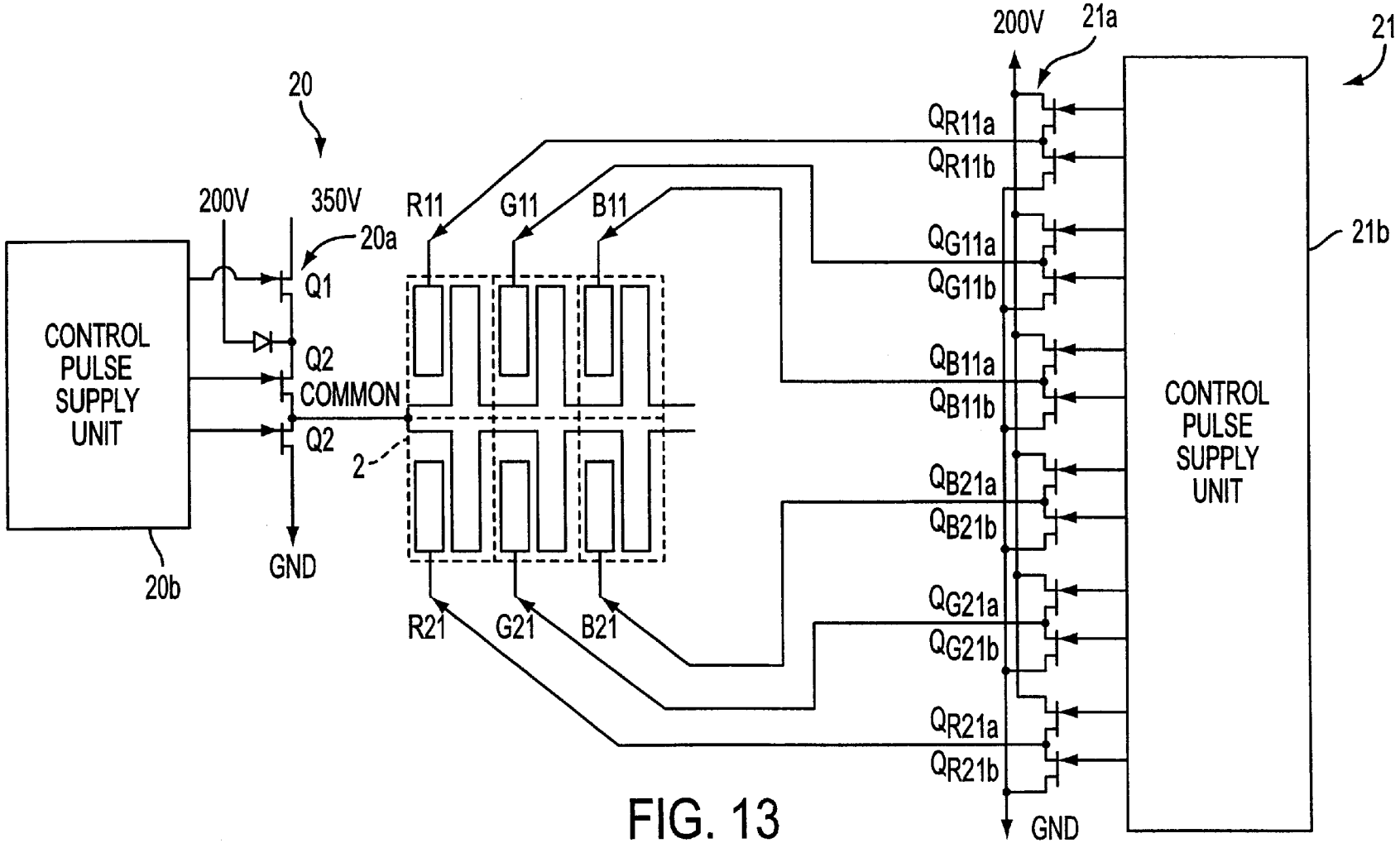
FIG. 13 is a block diagram of a driving circuit for explaining the controller for the planar display panel according to Embodiment 2 of the present invention.

FIG. 13 is a block diagram of a driving circuit comprised of the common electrode driver 20 and the individual electrode driver 21, the diagram showing the case of driving 2 pixels, i.e., 6 cells.

As shown FIG. 13, the common electrode driver 20 is connected to the common electrode for the respective cells and supplies the driving pulse to them. The common electrode driver 20 comprises a switching control unit 20*a* made up of a switching device Q1 which is connected to a power supply of 350 V and comprises an FET with its drain made open, a diode D1 to which a voltage of 200 V is applied, and a pair of push-pull driven switching devices Q2 and Q3 made up of two FETs which have the same characteristic and are connected to each other in symmetrical relation, as well as a control pulse supply unit 20*b* on the common electrode side which supplies control pulses to gates of the switching devices Q1–Q3.

The individual electrode driver 21 comprises a switching control unit 21*a* comprising pairs of push-pull driven switching devices $Q_{R11a}$ and $Q_{R11b}$, $Q_{G11a}$ and $Q_{G11b}$, $Q_{B11a}$ and $Q_{B11b}$, $Q_{B21a}$ and $Q_{B21b}$, $Q_{G21a}$ and $Q_{G21b}$, and $Q_{R21a}$ and $Q_{R21b}$, each pair being made up of two FETs which have the same characteristic and are connected to each other in symmetrical relation between a power supply of 200 V and a ground terminal GND for each of individual electrodes R11, G11, B11, R21, G21 and B21 serving as the individual electrodes 3, as well as a control pulse supply unit 21*b* on the individual electrode side which supplies control pulses to gates of those switching devices.

Figure 14:
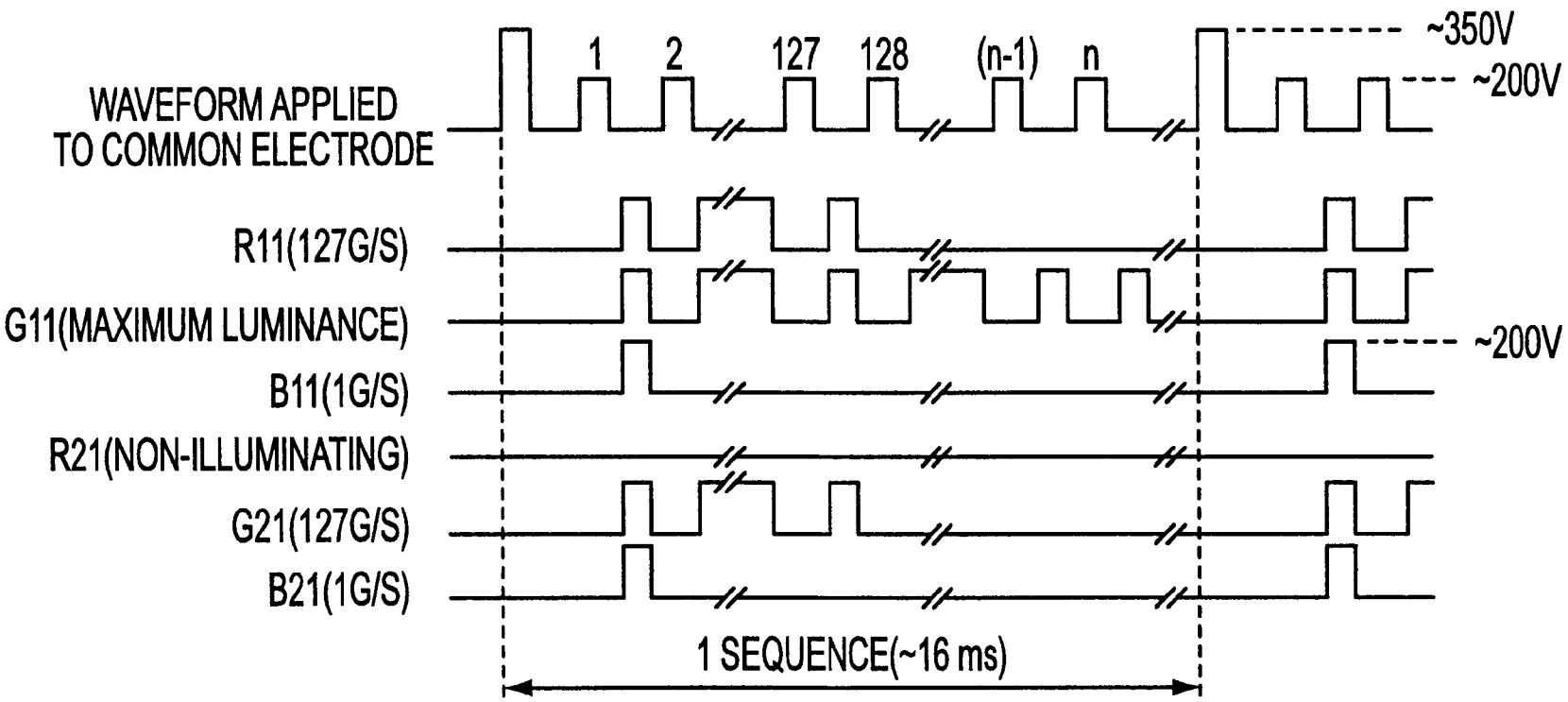
FIG. 14 is a chart of driving waveforms applied to electrodes for display in luminance gradation by the driving circuit of FIG. 13.

FIG. 14 is a chart of driving waveforms applied to the electrodes for display in luminance gradation by the driving circuit described above.

Basically, the display panel of this Embodiment can take only two states based on binary operation (whether to display or not) corresponding to an input pulse. Display is effected by applying a continuous display sustaining pulse, and a change of luminance (gradation) is controlled depending on the number of pulses which are applied to each of the individual electrodes within a unit time and insert in intervals between pulses applied to the common electrode.

As shown in FIG. 14, by first turning on the switching devices Q1 and Q2 and turning off the switching device Q3 in response to pulses supplied from the control pulse supply unit 20*b*, a priming pulse of 350 V is supplied to the common electrode 2 to start discharge. Then, by turning of f the switching device Q1 and turning on/off the switching devices Q2 and Q3 alternately, display sustaining pulses lowered down to 200 V are supplied to the common electrode 2.

For the individual electrodes, the number of pulses within one sequence is determined, and luminance of the cell driven by each individual electrode is maximized by applying the full number of pulses to the individual electrode and then lowered gradually by reducing the number of pulses applied to the individual electrode.

For example, luminance of the cells can be controlled as follows. 127 Pulses are supplied to the individual electrode R11 to provide a 127-gradation level of luminance; a number n of pulses are supplied to the individual electrode G11 to provide a maximum level of luminance in the case of n-gradation display; 1 pulse is supplied to the individual electrode B11 to provide a 1-gradation level of luminance corresponding to the darkest picture; and no pulses are supplied to the individual electrode R21 to bring it into a non-illuminating state. Likewise, 127 pulses are supplied to the individual electrode G21 to provide a 127-gradation level of luminance, and 1 pulse is supplied to the individual electrode B21 to provide a 1-gradation level of luminance.

Thus, the individual electrode functions under control of applying pulses during a display period which are in number corresponding to the number of gradation steps and can sustain the discharge display, and of stopping to apply the sustaining pulses during a non-display period. Note that luminous display is continued until the next pulse applied to the common electrode after the last pulse is applied to the individual electrode, and no light is emitted after the stop of application of the pulse to the individual electrode even if the pulse is applied to the common electrode.

Figure 15:
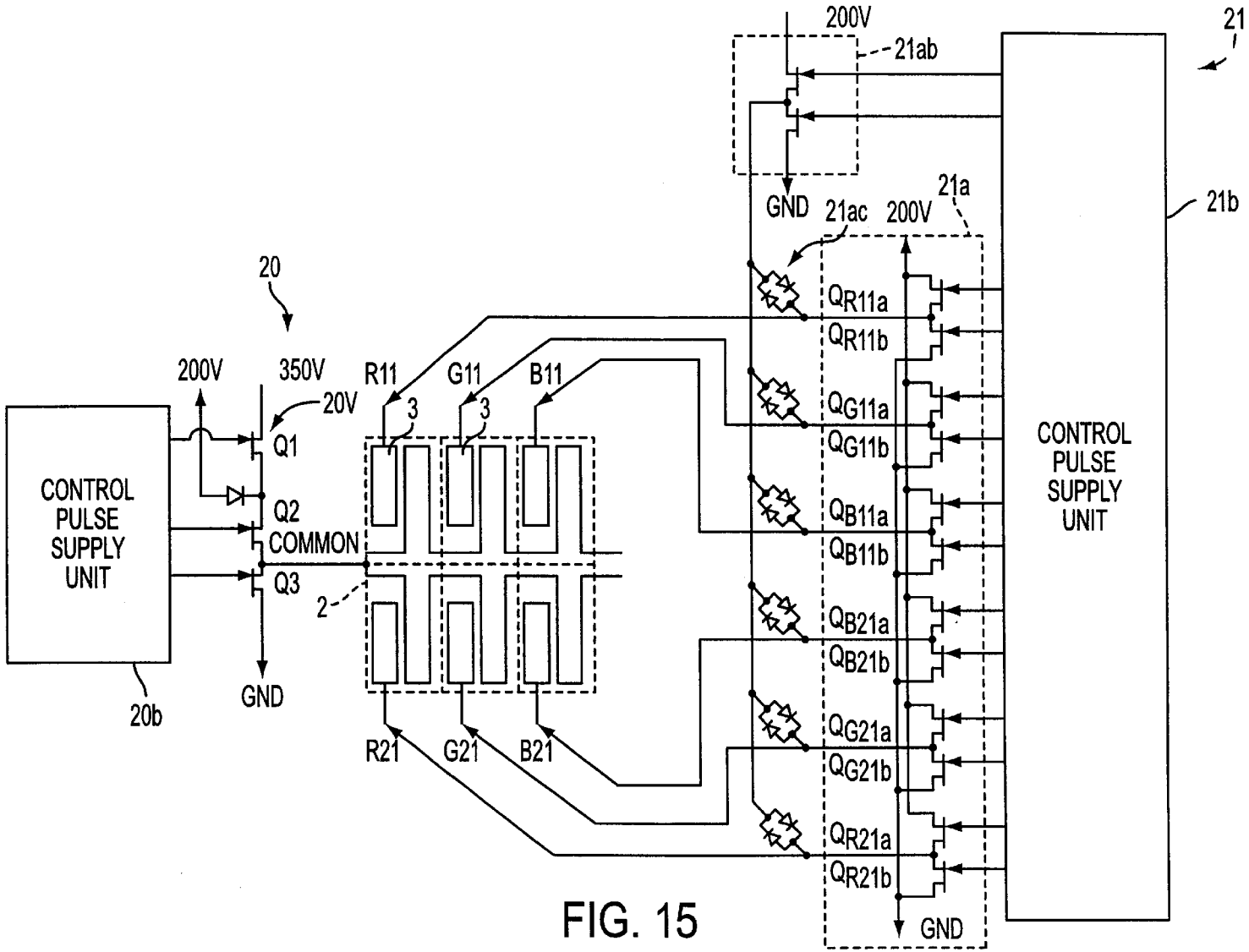
FIG. 15 is a block diagram of a driving circuit showing a modification of FIG. 13.

FIG. 15 shows a modification of the driving circuit shown in FIG. 13.

A driving circuit shown in FIG. 15 differs from that shown in FIG. 13 in construction of the switching control unit. In addition to individual electrode driving switch unit 21*aa* comprising pairs of push-pull driven switching devices made up of two FETs which have the same characteristic and are connected to each other in symmetrical relation between a power supply of 200 V and a ground terminal GND, the switching control unit includes a total driving switch unit 21*ab* comprising a pair of push-pull driven switching devices made up of two FETS which have the same characteristic and are connected to each other in symmetrical relation between the power supply of 200 V and the ground terminal GND, and a group of anti-parallel connected diodes 21*ac* interposed between the junction of each pair of FETs constituting the individual electrode driving switch unit 21*aa* and the junction of the pair of FETs constituting the total driving switch unit 21*ab*.

FIG. 16 shows driving waveforms applied to the electrodes for display in luminance gradation by the driving circuit shown FIG. 15, including an explanatory view for the waveforms.

To effect discharge display, a certain period of voltage sustaining time is required for aiding the next discharge display after application of the sustaining pulse. If the pulse is cut off without sustaining the voltage, light emitted from the next discharge would be suppressed.

By utilizing such a phenomenon, gradation display can be achieved with the driving circuit which controls the pulse waveform so as to apply a sustaining pulse having a relatively wide width and a sustaining pulse having a relatively narrow width (i.e., extinguishing pulse) to the individual electrode.

More specifically, as shown in FIG. 16A, when maximum luminance is desired, all pulses are applied as the wide pulses to the individual electrode (see the waveform applied to the individual electrode G11). On the other hand, for the cell requiring intermediate luminance, the narrow extinguishing pulses are applied from an intermediate point of the sequence (see the individual electrodes R11, G21).

By applying the pulse to the individual electrode in such a manner, discharge display is ceased in the period during which the narrow extinguishing pulses are applied. As a result, a level of display luminance is lowered and intermediate luminance is achieved. Incidentally, if the width of the narrow extinguishing pulse applied the individual electrode is properly selected, it would be possible to stop emission of light from the cell upon application of the pulse to only the common electrode.

As shown in FIG. 16B in enlarged scale, the relatively wide sustaining pulse has a width of the sum of periods I and II, while the relatively narrow sustaining pulse has a width of the period I. Further, these periods I and II, a period IIIl between the relatively wide sustaining pulse and the relatively narrow sustaining pulse, and a period IV after the relatively narrow sustaining pulse are set by switching control of the total driving switch unit 21*ab* and the individual electrode driving switch unit 21*aa*, as shown in FIG. 16C.

For example, during the period I, the high-side PET and the low-side FET of the total driving switch unit 21*ab* are controlled to turn on and off, respectively, and the high-side FET and the low-side FET of the individual electrode driving switch unit 21*aa* are both controlled to turn off. Also, during the period II, the high-side FET and the low-side FET of the total driving switch unit 21*ab* are both controlled to turn off, and the high-side PET and the low-side FET of the individual electrode driving switch unit 21*aa* are controlled to turn on and off, respectively. Likewise, during the periods IIIl and IV, the high-side FETs and the low-side FETs of the switch units 21*ab*, 21*aa* are controlled as shown in FIG. 16C.

Figure 17:
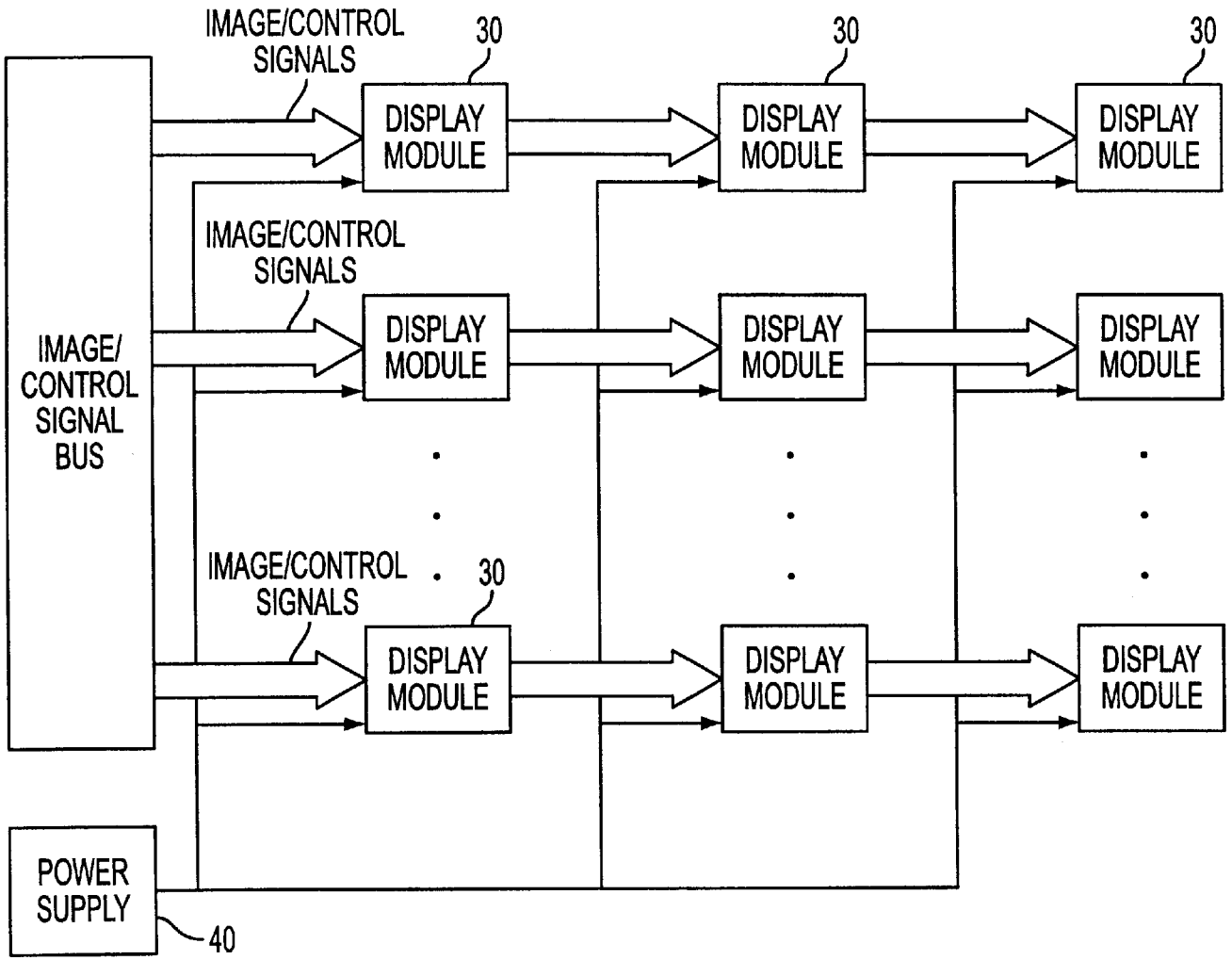
FIG. 17 is a system block diagram of the planar display panel according to Embodiment 2 of the present invention.

FIG. 17 is a system block diagram of the planar display panel.

As shown in FIG. 17, a display section is constituted by a plurality of display modules 30 each being a constituent element and comprising four display units (2×2) of 8×8 dots combined with each other. The display modules 30 arranged in the horizontal direction (direction of scan line) are cascaded to be supplied with the same image and control signals in common.

A power supply 40 is connected to the display modules 30 in parallel so that a voltage drop will not occur between the display modules 30.

Figure 18:
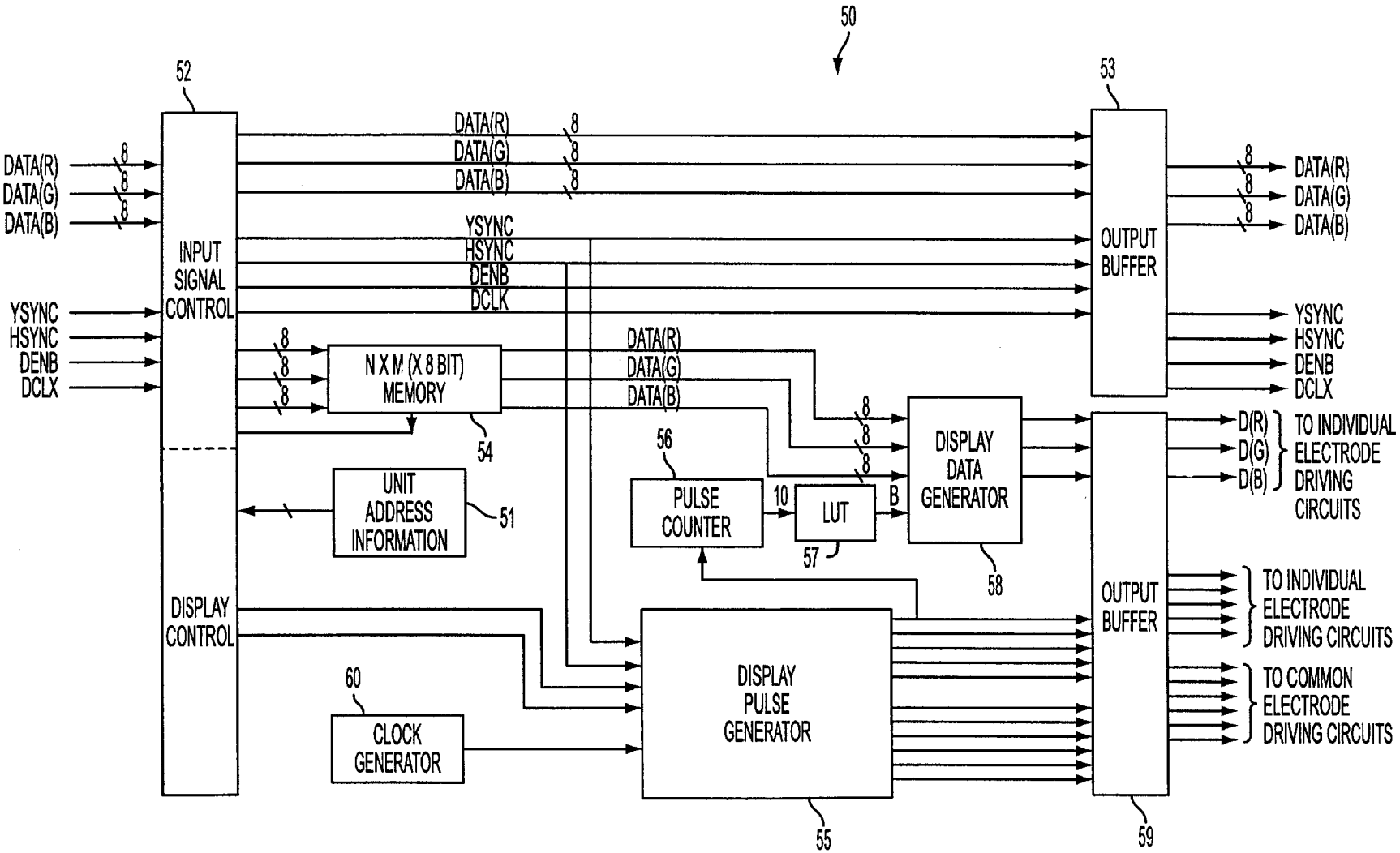
FIG. 18 is a block diagram of a signal processing circuit for applying control signals to driving circuits of display modules cascaded in FIG. 17, for explaining the controller for the planar display panel according to Embodiment 2 of the present invention.

FIG. 18 is a block diagram of a signal processing circuit for applying control signals to driving circuits of the cascaded display modules.

A signal processing circuit 50 shown in FIG. 18 comprises a module address information storage unit 51 for storing specific address information, an input signal control/display control unit 52 for allowing input data to pass through it and taking data, which the relevant display module including the unit 52 is to represent by itself, out of a position indicated by the specific address and a display effective signal in the data, a through data output buffer 53 for outputting the data, which has passed through the input signal control/display control unit 52, to the adjacent display module cascaded downstream, a memory 54 into which the data taken out of the input signal control/display control unit 52 is written in response to a write control signal, and from which the data is read in response to a read control signal, a display pulse generator 55 for generating common electrode and individual electrode driving pulses based on the data taken out of the input signal control/display control unit 52, a pulse counter 56 for counting the common electrode driving pulse output from the display pulse generator 55, a look-up table 57 for converting the number of pulses counted by the pulse counter 56 into a numerical value of gradation data, a display data generator 58 for outputting individual electrode control data based on comparison between the gradation data from the look-up table 57 and the individual electrode driving display data read from the memory 54, an output buffer 59 for outputting outputs of the display pulse generator 55 and the display data generator 58 to the individual electrode driving circuits and the common electrode driving circuits, and a clock generator 60 for applying clocks to the display pulse generator 55. In FIG. 18, DATA(R), DATA(G) and DATA(B) represent RGB data of 8 bits, respectively, Vsync a vertical synch signal, Hsync a horizontal synch signal, DENB a data enable signal, and DCLK a synch signal.

The display modules 30 cascaded in the horizontal direction are assigned with specific different module addresses from the module address information storage unit 51. Also, signals for display and display control are output through the adjacent module, and the through-output data signals are supplied to the input signal control/display control unit 52.

Figure 19:
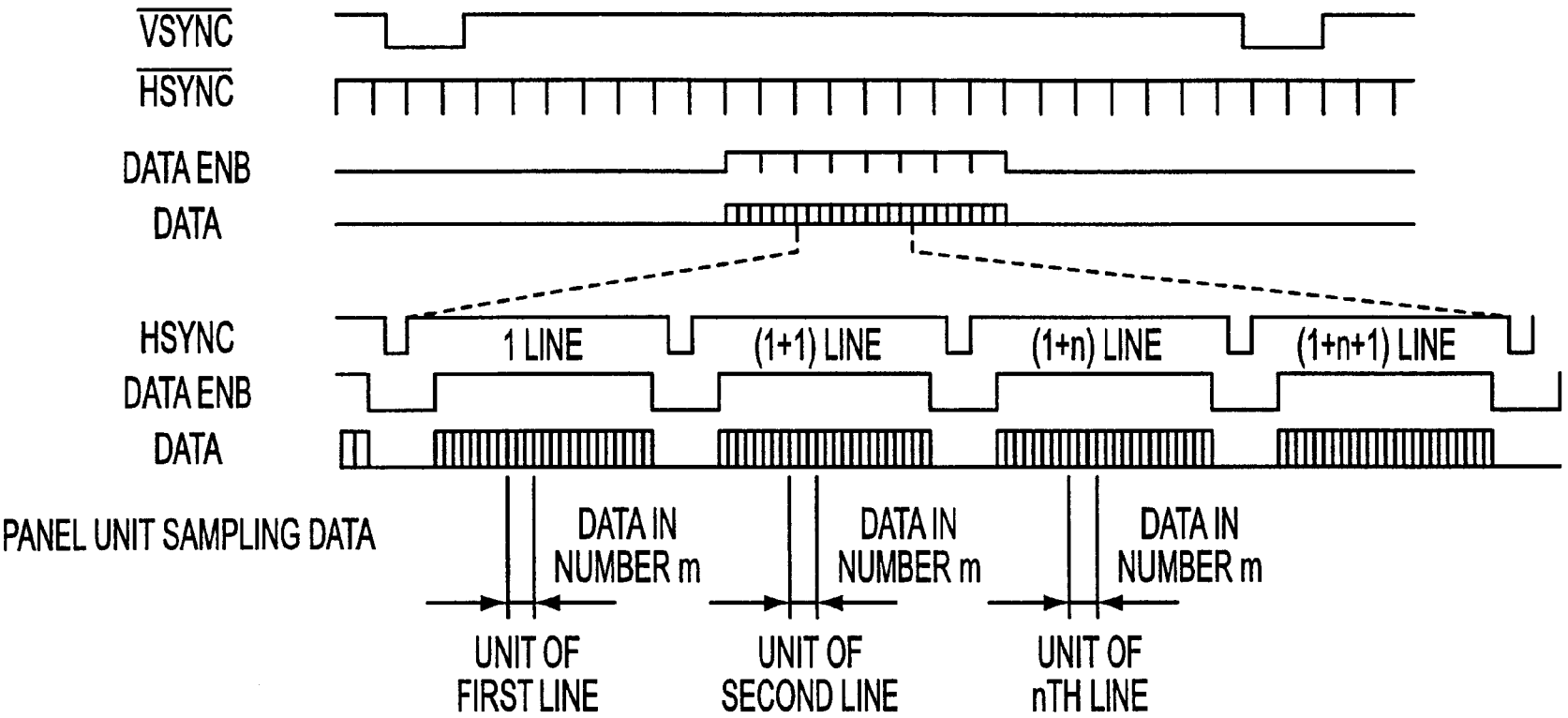
FIG. 19 is a waveform chart for explaining the operation of the signal processing circuit shown in FIG. 18, FIGS. 20A and 20B are a block diagram and a flowchart for explaining a gradation display process to create gradation data for control of individual electrodes using a pulse counter 56, a look-up table 57 and a display data generator 58 all shown in FIG. 18.

As shown in FIG. 19, the input signal control/display control unit 52 calculates a start position of data, which the relevant display module including the unit 52 is to represent by itself, based on the specific address data, a display effective signal (DATA ENB) in the data, and the vertical and horizontal synch signals, and then samples the display data from the calculated start position, followed by storing the display data in the memory 54.

More specifically, the position of the relevant display module in the vertical and horizontal directions is first determined from the specific address information. This is realized from the fact that the specific address has information indicating in which position the relevant display module locates with respect to the vertical and horizontal directions. The horizontal position and the vertical position indicated by the specific address are given by numerical values resulted from dividing respective data of the position information of the specific address by 16 that corresponds to the number of pixels of the display module in both the directions.

For the horizontal position, the number of dot clocks is counted from the time at which ENB has become effective after input of the horizontal synch signal, and the input data is passed through until reaching the position (counted value) determined by the specific address. Upon reaching the determined position, the data of 16 pixels starting from that clock is sampled. The subsequent data is passed through again.

For the vertical position, as with the horizontal position, a vertical line counter is reset upon input of the vertical synch signal, and then the number of lines in which the data effective signal (ENB) is input. The input data is passed through until reaching the position (counted value) determined by the specific address. Upon reaching the determined position, the data of 16 pixels starting from that clock is sampled. The subsequent data is passed through again.

By combining the above sampling processes in the horizontal and vertical directions with each other, the data of 16×16 in the display data, which the relevant display module is to represent, is written into the memory 54. The memory 54 is of a 2-stage structure comprising a memory section into which a display signal is written from the outside, and a memory section from which the signal is read for display. Usually, the two memory cells are changed over to alternately perform functions of writing and reading in match with the synch signal for switching display.

Thus, with the construction shown in FIG. 18, specific addresses are assigned respectively to a plurality of display units so that, when those display units are combined with each other, the specific addresses can serve as position information of the individual display units. Then, the data which the relevant display module is to represent by itself can be determined and stored from the input display data and synch data, enabling display control to be performed based on the stored data. Further, the individual display modules are identifiable one by one. Accordingly, by transferring the control data and the specific address of each display module through a data bus, only the designated display module can receive the control data. This enables each display module to make control such that the input data is passed through until reaching the position (counted value) determined by the specific address and upon reaching the determined position, the data of 16 pixels starting from that clock is sampled, and then the subsequent data is passed through again.

As one example of display control, by inputting the display data and the specific address of the display module in a blanking period (data ineffective time) of the display data, such data as, for example, correcting luminance variations among the display modules individually can be set in the display modules. It is hence possible to simplify the adjusting operation to achieve uniform display, and to facilitate the maintenance.

Figure 20A:
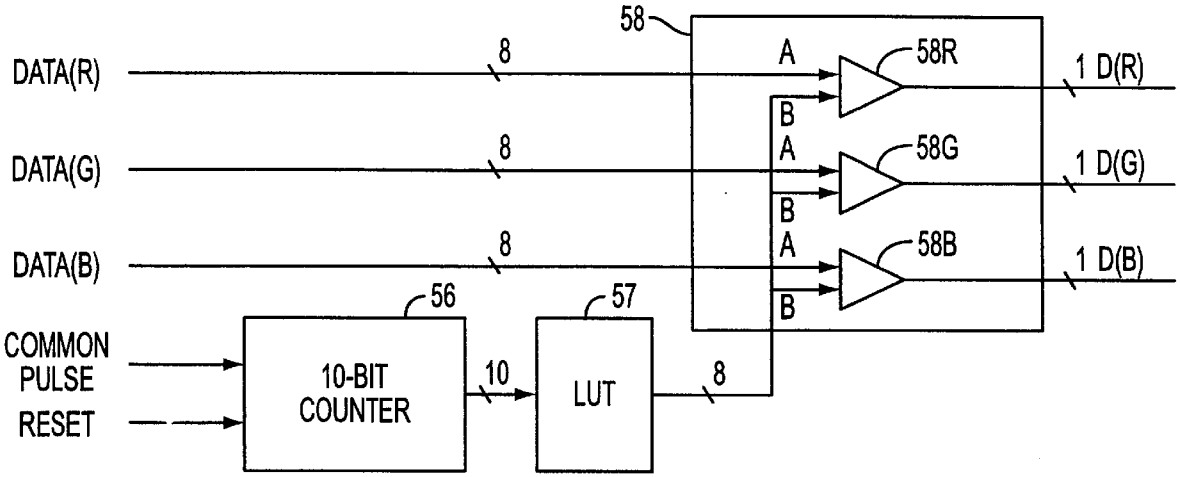
Figure 20B:
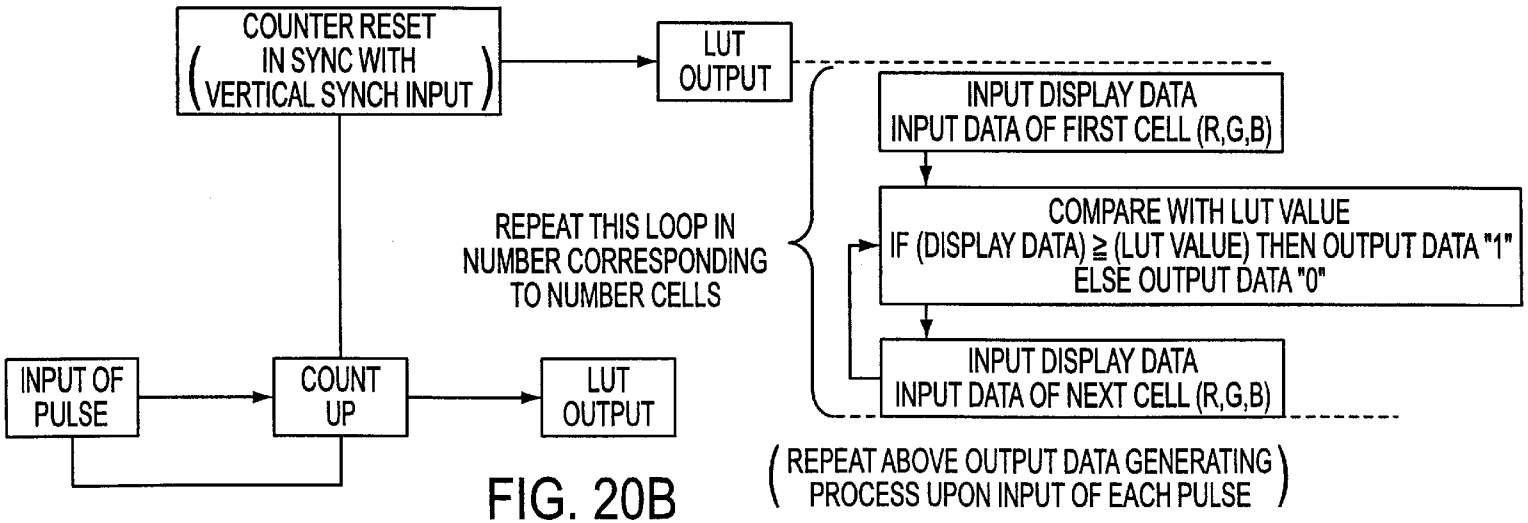

FIGS. 20A and 20B are a bloc diagram and a flowchart for explaining a gradation display process to create gradation data for control of the individual electrodes using the pulse counter 56, the look-up table 57 and the display data generator 58 mentioned above.

Image data for red (R), green (G) and blue (B) to be developed into the display module from the outside are each input as binary data of 8 bits in the case of 256 gradation steps (16.70 millions tones) for each color. Because of difference in gradation representation format between those image data and data dealt by the display module, the input data must be subjected to format conversion. The gradation representation format used in the display module is expressed by the number of sustaining pulses. Accordingly, the input data in binary format must be converted into data using the number of pulses.

It is, however, usual that the number of sustaining pulses input within one sequence is not always 256. Therefore, the display data cannot be obtained depending on a value of the binary image data alone. The pulse counter 56 for counting the sustaining pulses and the look-up table 57 for conversion of a numerical value in comparison with the binary image data are hence required.

The look-up table 57 is constructed so as to output data having a value determined based on a certain regularity with respect to the input data.

Figure 21:
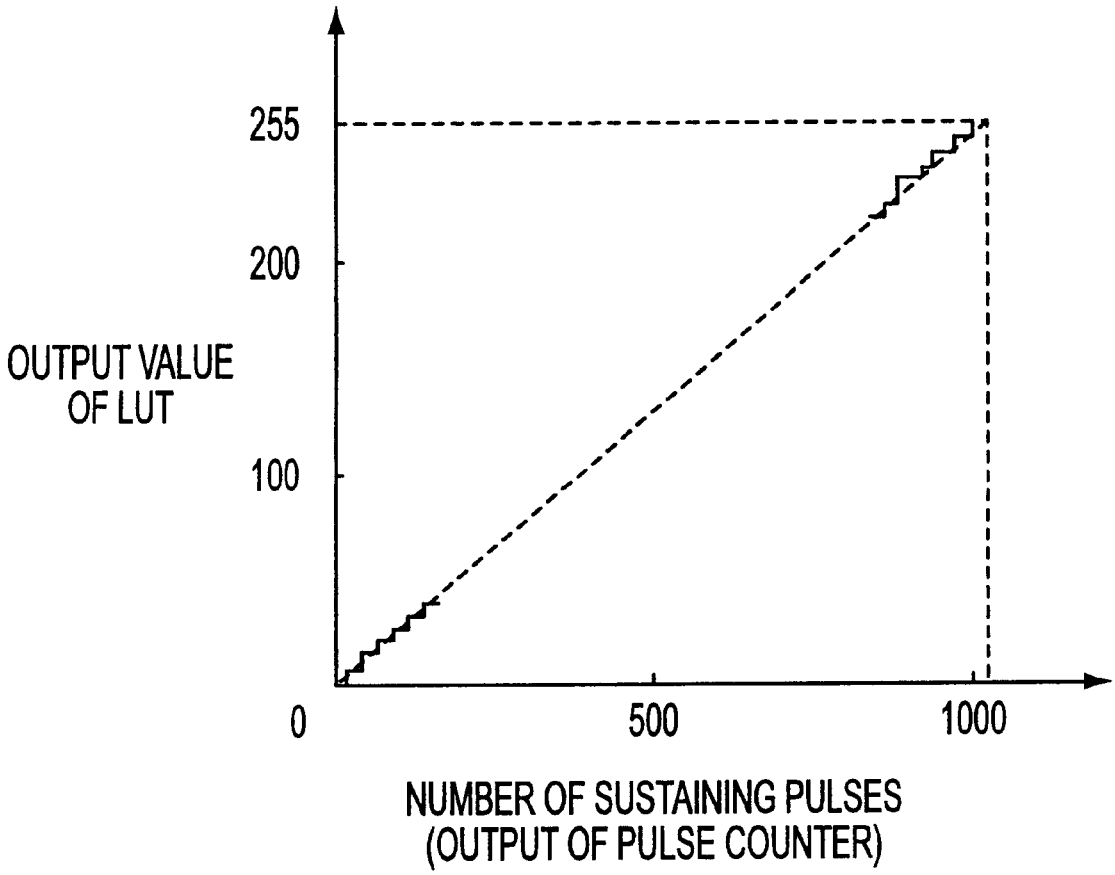
FIG. 21 is a graph of an input/output characteristic of the look-up table 57 shown in FIG. 18.

FIG. 21 is a graph of an input/output characteristic of the look-up table 57. In the look-up table 57, values of 0–255 are assigned in ascending order to the input of the sustaining pulses of 10 bits (1024) delivered from the counter 56. Because the number of sustaining pulses and the output value are each given as an integer value, the input/output characteristic of the look-up table 57 is represented by a step-like graph having discrete values. By changing the input/output characteristic curve of the graph, the desired number of sustaining pulses can be allocated to the output value.

The use of the look-up table 57, which can freely change an output with respect to an input, makes it possible to establish correlation between the image input data and the number of sustaining pulses in point of which one is larger than the other in terms of value representing color tone, to control the number of sustaining pulses per one gradation step, and to achieve luminance modulation of the display cell.

More specifically, as shown in FIG. 20A, the display data generator 58 is constituted by comparators 58R, 58G, 58B of 8 bits. It is assumed, for example, that when the sustaining pulse is applied to effect discharge display, control data for the individual electrode is set to "1" (output of a display pulse), and when the control is to be performed to establish a non-display state, the control data is set to "0" (non-display state). Then, as shown in FIG. 20B, the pulse counter 56 comprising a 10-bit counter starts to count up the common electrode driving pulse output from the display pulse generator 55 upon counter reset (in synch with an vertical synch input), and the display data generator 58 compares a value f (the count number of sustaining pulses), which is resulted from converting an output of the pulse counter 56 by the look-up table 57, with the display image data, thereby obtaining the control data as follows;

if f≦display image data, then data is set to "1", and if f >display image data, then data is set to "0".

The above comparing operation is repeated in number corresponding to the number of cells of the display module for each of the pulses applied to the individual electrodes until processing all the display data. The resulting data is successively transferred to the control pulse supply unit for switching control of the individual electrodes, shown in FIG. 13 or FIG. 15, so that whether to apply a pulse or not, a pulse shape, a voltage value, etc. for the next individual electrode are determined.

As a result of the foregoing control process, luminance display corresponding to the input image data can be achieved for each cell.

With this Embodiment 2, as described above, in a planar display panel comprising a common electrode for driving all of display cells together, which constitute a display screen, or for partly driving any plural number of the display cells at a time, and individual electrodes for individually driving the display cells on the cell-by-cell basis, there is provided a driving circuit for changing luminance in accordance with the number of pulses applied to each of the individual electrodes within a unit time, thereby effecting gradation display. It is therefore possible to achieve gradation control with switching control performed for each of the individual electrodes provided independently of one another in one-to-one relation to the display cells.

Also, since the driving circuit effects the gradation display based on control of application of a relatively wide sustaining pulse and a relatively narrow extinguishing pulse which are used as the pulses to be applied to each of the individual electrodes within the unit time, discharge display can be stopped during a period in which the extinguishing pulse is applied, and hence the gradation display can be achieved as desired.

Further, the planar display panel is constituted by display modules as constituent elements each comprising a plurality of display units combined into a pattern of row-and-column matrix. In the planar display panel, the display modules arranged in the horizontal direction are cascaded, and a power supply is connected to the display modules in parallel. A signal processing circuit for applying control signals to the driving circuits of each of the display modules comprises an address information storage unit for storing specific address information, an input signal control unit for allowing input data to pass through it and taking data, which the display module including that control unit is to represent by itself, out of a position indicated by the specific address and a display effective signal in the data, a through data output buffer for outputting the data, which has passed through the input signal control unit, to the adjacent display module cascaded downstream, a memory into which the data taken out of the input signal control unit is written in response to a write control signal, and from which the data is read in response to a read control signal, a display pulse generator for generating common electrode and individual electrode driving pulses based on the data taken out of the input signal control unit, a counter for counting the common electrode driving pulse output from the display pulse generator, a look-up table for converting the number of pulses counted by the counter into a numerical value of gradation data, a display data generator for outputting individual electrode control data based on comparison between the gradation data from the look-up table and the individual electrode driving display data read from the memory, and an output buffer for outputting output s of the display pulse generator and the display data generator to the individual electrode driving circuits and the common electrode driving circuits. Therefore, when data control is performed for the plurality of display modules combined with each other, individual control of the respective display modules in accordance with the display data can be achieved by taking in the display data corresponding to the address of each display module.

Embodiment 3

In this Embodiment 3, a description will be made on a method driving the planar display panel having the electrode structure described in the above Embodiment 1.

This Embodiment 3 is on an assumption that the display pixel has a size of 10×10 $mm^2$, the display cell has a size of 3×9 $mm^2$, the electrode gap between the common electrode 2 and the individual electrode 3 is 100 $\mu$m, and discharge gas (Ne—Xe (5%)) is filled in the discharge space having a height of 600 $\mu$m at 500 Torr in a sealed state.

Figure 22:
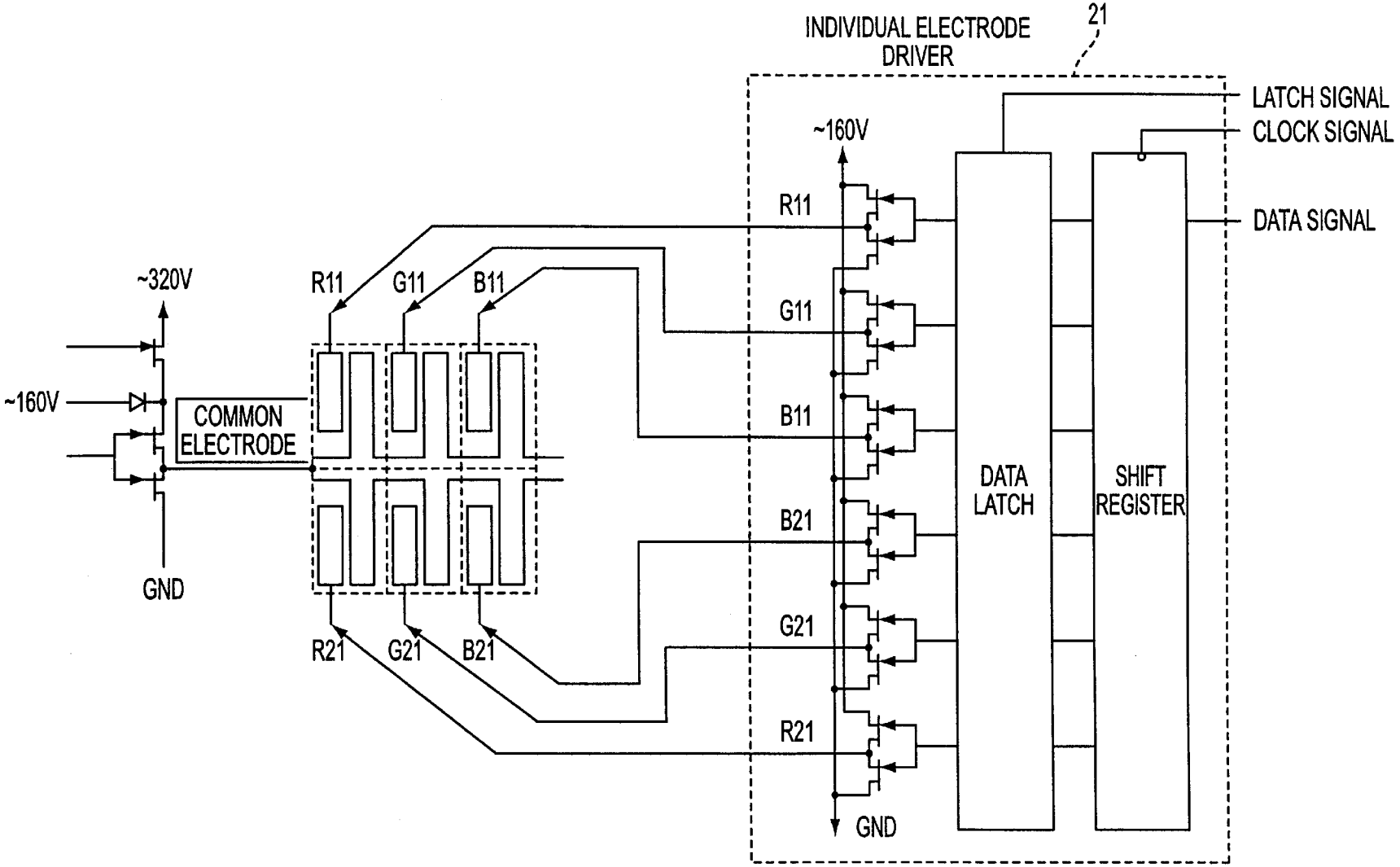
FIG. 22 is a block diagram of an individual electrode driving circuit for explaining a method for driving a planar display panel according to Embodiment 3 of the present invention.
Figure 23:
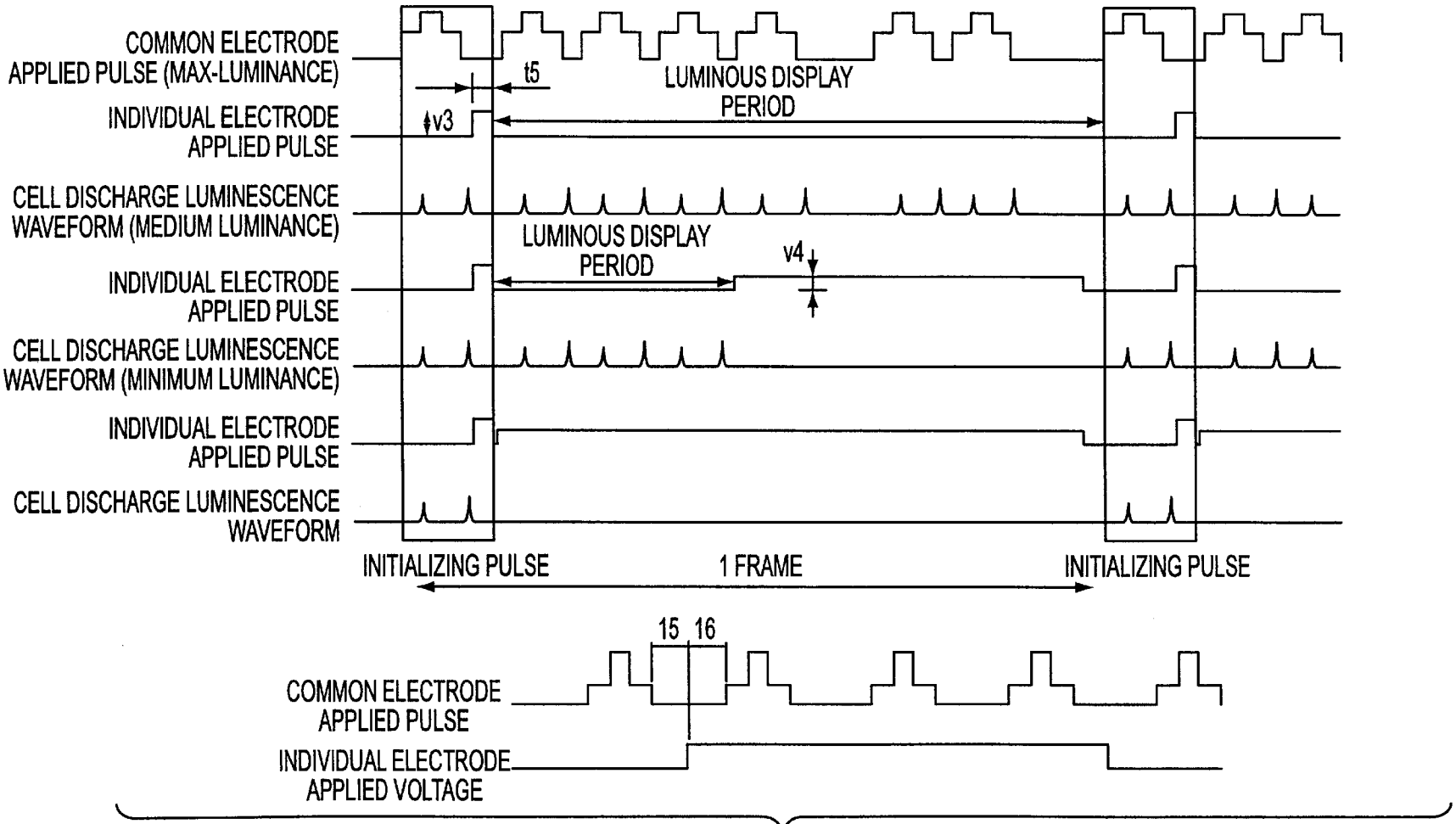
FIG. 23 is a chart of a driving sequence for explaining the method for driving the planar display panel according to Embodiment 3 of the present invention.

FIG. 22 shows in more detail the internal structure of the control pulse supply unit 21*b* of the individual electrode driver 21 shown in FIG. 13. FIG. 23 shows one example of a driving sequence for driving the planar display panel.

Since the planar display panel is constructed as shown in FIG. 12, one pair of common electrode driving circuits and individual electrode driving circuits in number corresponding to the number of display cells are required.

Figure 24A:
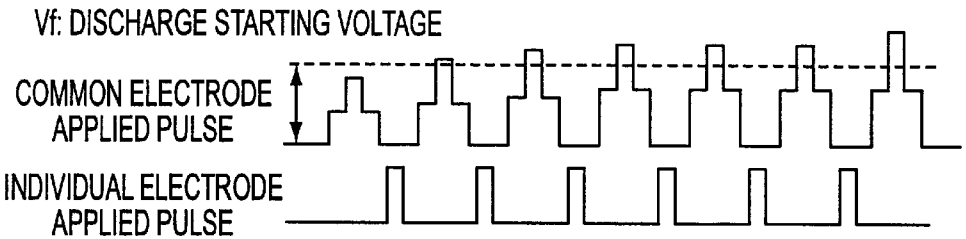
FIGS. 24A, 24B and 24C are explanatory views of the operation of the display panel for explaining the method for driving the planar display panel according to Embodiment 3 of the present invention.
Figure 24B:
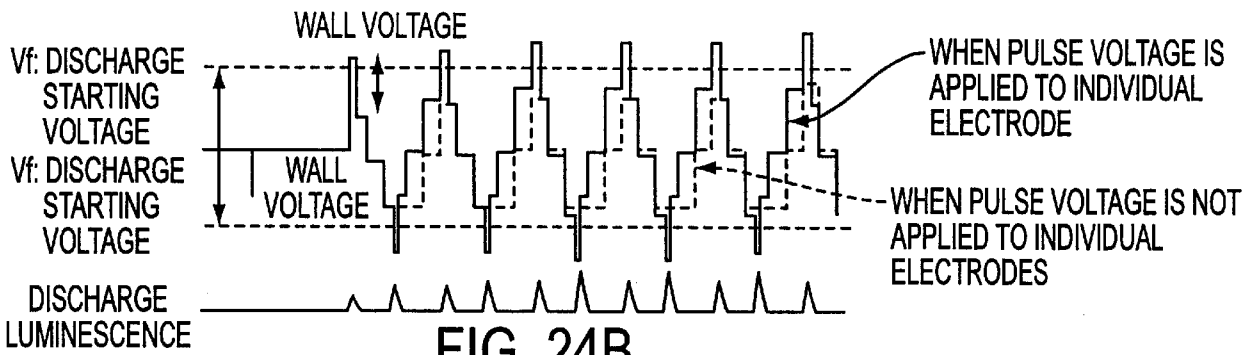
Figure 24C:
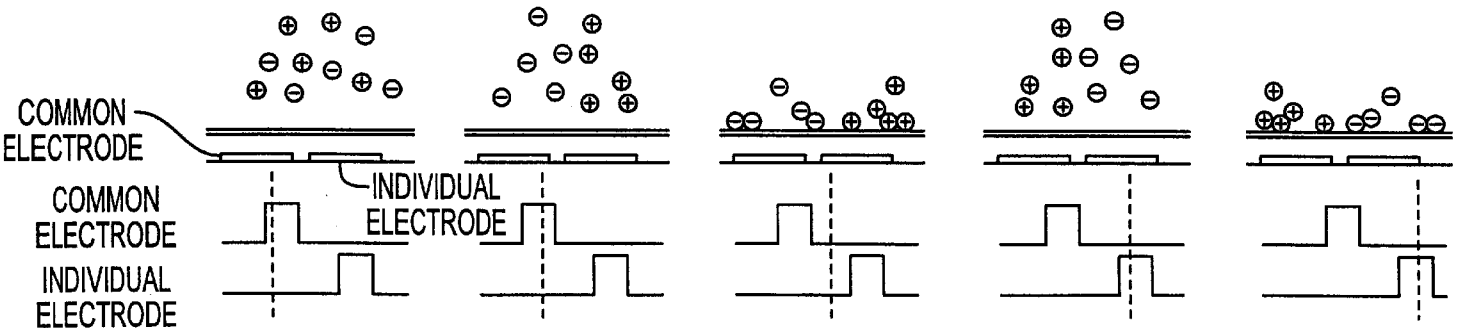

In planar display panels utilizing discharge, as shown in FIGS. 24A, 24B and 24C, it is conventional that a high-voltage pulse is alternately applied to a pair of electrodes, i.e., a common electrode and one individual electrode opposing to the common electrode in the same plane in this embodiment, and discharge is sustained with the aide of wall charges accumulated on an insulator defining the discharge cell.

To perform display control by the conventional method, however, a high-voltage pulse having the same frequency as that applied to the common electrode must be applied to the individual electrode during the display operation, and a load of the individual electrode is increased. Accordingly, a driving device comparable to that used for driving the common electrode is required.

Figure 25:
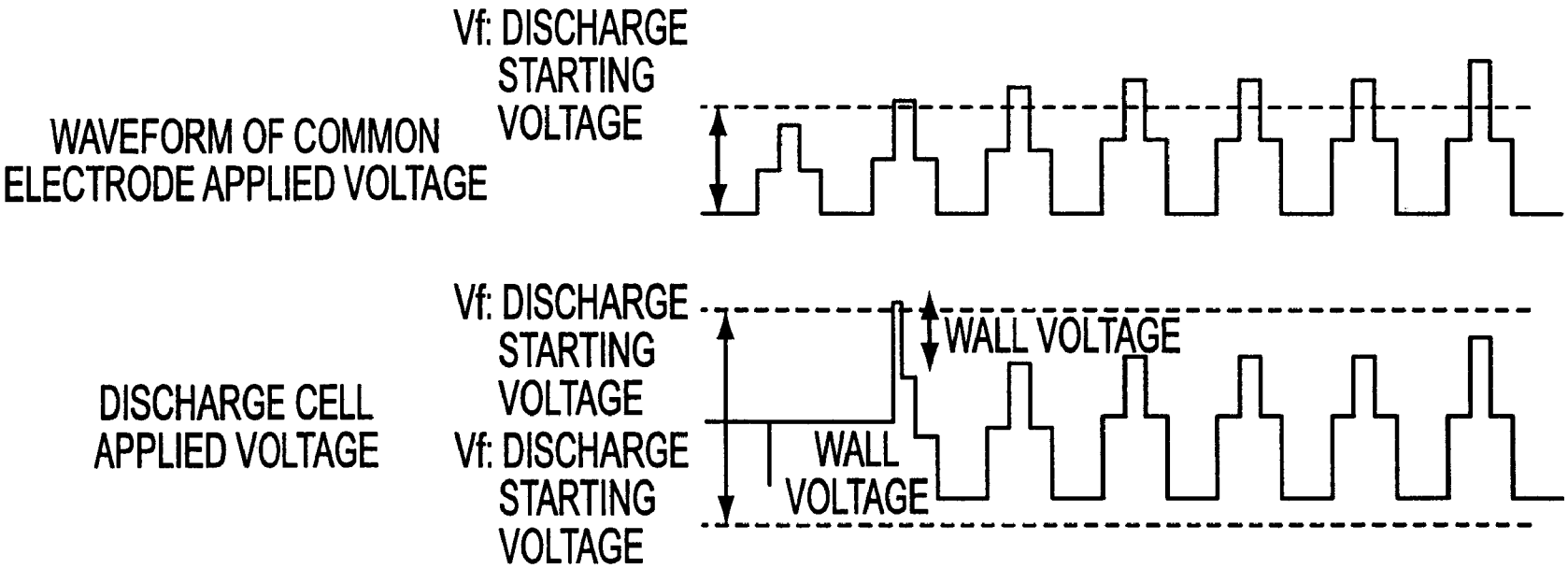
FIG. 25 is an explanatory view of the operation of the display panel for explaining the method for driving the planar display panel according to Embodiment 3 of the present invention.

Also, if a high-voltage pulse for discharge is applied to the common electrode alone, as shown in FIG. 25, wall charges are accumulated due to discharge produced by the voltage pulse applied to the common electrode, thereby acting to weaken the voltage applied externally. For this reason, the voltage in each display cell cannot reach the discharge starting voltage even with subsequent voltage pulses applied. In other words, the pulse voltage is clamped to the negative direction due to a wall potential caused by first discharge to such an extent that the discharge starting voltage is not exceeded. This stops discharge in spite of the high-voltage pulse being applied. When the voltage in each display cell reach the discharge starting voltage, discharge light is generated, but the wall charges are accumulated in a larger amount and act to further weaken the voltage applied externally.

Taking into account the above-mentioned state of art, the following driving method is employed in this embodiment to sustain the discharge display.

First, to cope with the above-mentioned phenomenon that discharge is ended only with the voltage pulse initially applied to the common electrode, a pulse with a voltage V3 having a crest value higher than the discharge sustaining voltage is applied, as an initializing pulse, to all the individual electrodes subsequent to the pulse applied to the common electrode, as shown in FIG. 23.

While V3=160 V is set in this Embodiment 3, the voltage V3 may have any desired value in the range not lower than the minimum discharge sustaining voltage (about 130 V) but not higher the discharge starting voltage (about 220 V).

Then, a width t5 of the pulse applied to the individual electrode is set to be not less than 3 $\mu$sec in consideration of a delay of discharge and an accumulation time of wall charges. An upper limit of the pulse width depends on only time allocation over the entire sequence, and is set to 10 $\mu$sec.

By so applying the initializing pulse, the voltage pulse applied to the individual electrode can act to promote accumulation of wall charges with the opposite polarity (which enhance the voltage applied to the common electrode) by utilizing the above-mentioned wall charges which are accumulated due to discharge produced by the voltage pulse applied to the common electrode and act to weaken the voltage applied to the common electrode. This enables discharge to surely start upon the next voltage pulse being applied to the common electrode.

Figure 26A:
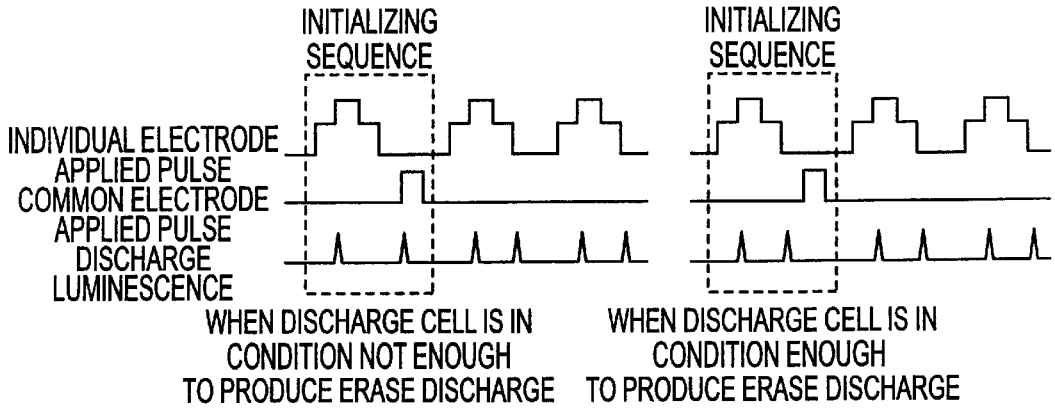
FIGS. 26A, 26B and 26C are explanatory views of the initializing operation of the display cells for explaining the method for driving the planar display panel according to Embodiment 3 of the present invention.
Figure 26B:
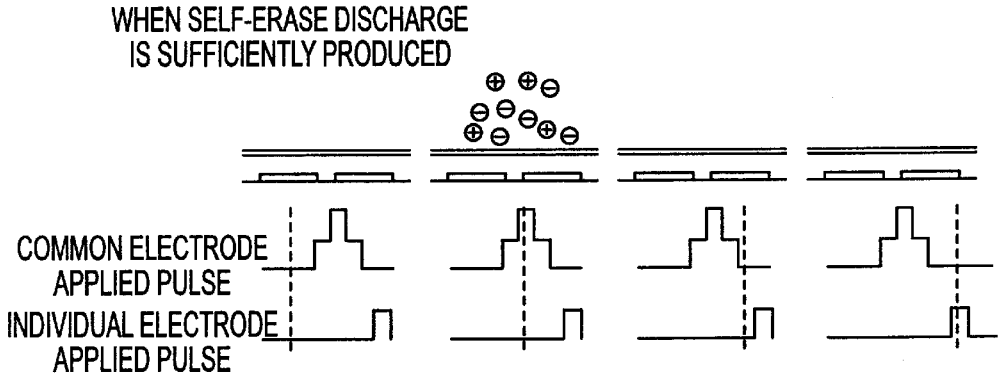
Figure 26C:
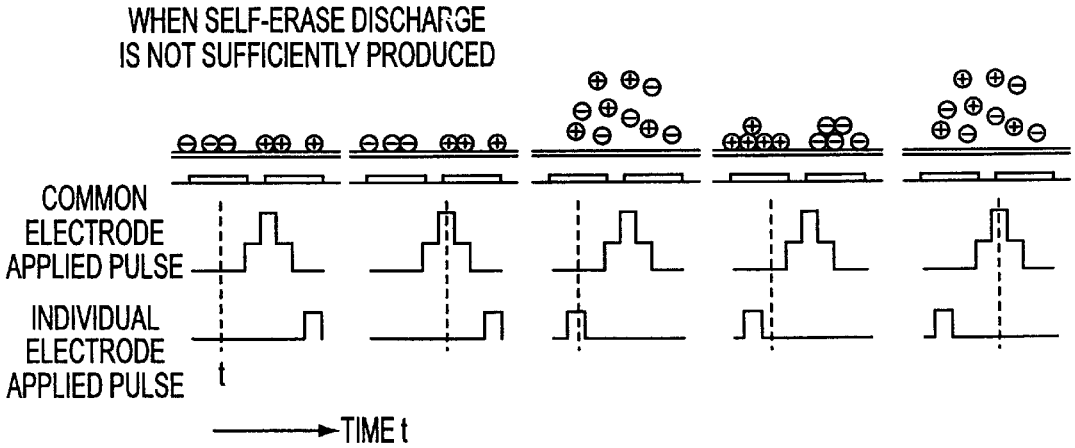

With the initializing pulses applied to the common electrode and the individual electrode, as shown in FIGS. 26A, 26B and 26C, discharge is produced by the pulse applied to the common electrode in normal display as a result of the above-mentioned combination of the voltage pulses applied to the common electrode and the individual electrode. In the case where the pulse applied to the common electrode cannot bring about a dischargeable state, discharge is not produced by the voltage pulse applied to the common electrode, but produced by the voltage pulse applied to the individual electrode.

In the latter case, because wall charges accumulated due to discharge produced on the individual electrode act to enhance the pulse applied to the common electrode, the starting and erase discharge can be surely produced from the time when the next pulse is applied to the common electrode.

With the above-described control, it is possible to periodically initialize those display cells which have shifted to a region of unstable discharge, and to achieve stable display.

Display luminance is determined by the number of voltage pulses applied to the common electrode within a predetermined period (about 16 ms), the period being called one sequence period. In this Embodiment 3, the number of voltage pulses applied to the common electrode within one sequence is set to 766 including the initializing and discharge sustaining pulses. Application of the voltage pulse to the individual electrode for stability of discharge is performed, as shown in FIG. 23, at the head of each sequence in combination with the voltage pulse applied to the common electrode.

Further, to produce display discharge upon the voltage pulse being applied to the common electrode, a pulse having a voltage value sufficiently higher than the discharge starting voltage of each of the display cells constituting the planar display panel is used as the pulse applied to the common electrode, thus enabling the discharge to be started reliably. In addition, the amount of wall charges generated upon the discharge is increased so that the discharge starting voltage with the opposite polarity is retained by the wall charges, and the so-called erase discharge, i.e., discharge produced by a voltage induced with only the wall charges when the pulse applied to the common electrode falls.

Figure 27A:
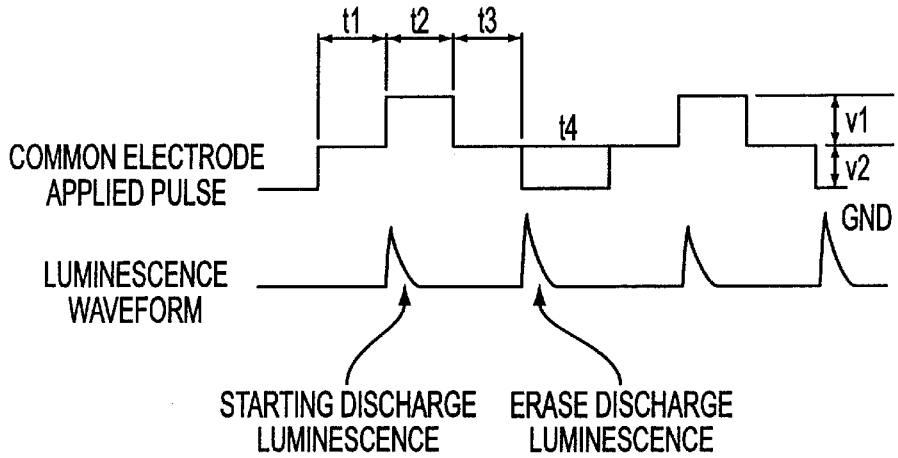
FIGS. 27A and 27B are explanatory views of the discharge operation for explaining the method for driving the planar display panel according to Embodiment 3 of the present invention.
Figure 27B:
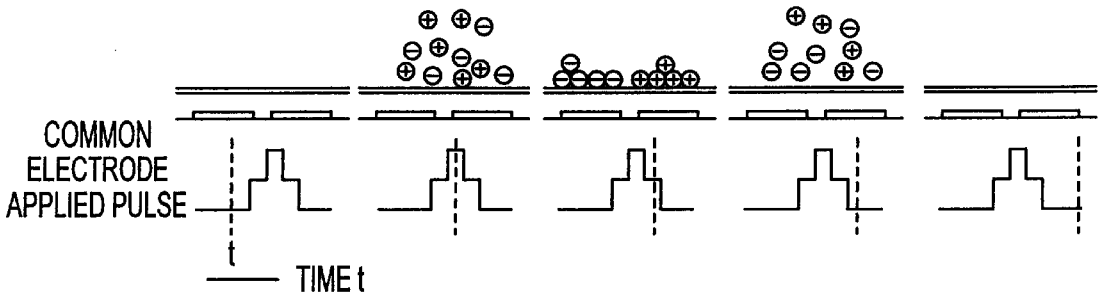

With such a phenomenon, as shown in FIGS. 27A and 27B, there present no wall charges in the display cell after the pulse has been applied to the common electrode. Alternatively, even if present, the remaining wall charges are very weak. Accordingly, the wall charges have no longer an effect of impeding the occurrence of discharge when the next voltage pulse is applied to the common electrode. As a result, discharge is surely produced for each voltage pulse applied to the common electrode.

In order to produce the discharge as described above, the voltage pulse applied to the common electrode must have a high voltage and a high crest value. This requires the pulse edges to be so steep that the pulse can rise and fall within a predetermined time. The necessity of applying a pulse having steep edges raises problems of, e.g., making it more difficult to construct a necessary circuit and control the discharge.

Considering the above problems, the pulse applied to the common electrode is given as two-step composite voltage pulse created by superposing two voltage pulses with each other. A first-step pulse not enough to start discharge is used to apply a DC bias, and a second-step pulse is used to apply a voltage higher than the discharge starting voltage, thereby producing discharge.

By employing the above method, a time required from application of the discharge starting voltage to the display cell until reaching the driving maximum voltage can be cut down, and application of the voltage can be completed within a delay of discharge in the display cell.

In this Embodiment 3, as shown in FIGS. 27A and 27B, it was required that a period t1 from the rising of the first-step pulse to the rising of the second-step pulse was set to be not less than 1 $\mu$sec from relation between the on-time of a first-step pulse generating circuit and a second-step pulse generating circuit.

Also, as shown in FIGS. 27A and 27B, since the discharge starting voltage of the display cell is about 220 V, the first-step pulse having a voltage value V2 and the second-step pulse having a voltage value V1 each have a crest value of 160 V, whereby a voltage value resulted after superposing both the pulses is 320 V (V1+V2).

The crest value of the first-step pulse is required to be selected from the range larger than the minimum discharge sustaining voltage but smaller the discharge starting voltage. The maximum voltage of the superposed voltage pulse was set not to exceed 350 V, taking into account a limit based on the breakdown voltage of the insulating layer of the display cell.

Further, the crest values of the first-step pulse and the second-step pulse were both set to 160 V and the crest value of the superposed pulse was set to 320 V in consideration of the facts that better efficiency is achieved in display by setting the crest value of the second-step pulse to be equal to or larger than the crest value of the first-step pulse, the number of external power supplies can be reduced, and the erase discharge can be surely produced.

The maximum voltage pulse applied at this time is set to have a voltage (320 V) allowing wall charges to be accumulated after the start of discharge in an amount enough to produce the erase discharge in the display cell, and a maximum voltage sustaining period t2 shown in FIG. 27A is set to be not less than 3 $\mu$sec that corresponds to a delay time in accumulation of the wall charges. Accordingly, the amount of wall charges enough to produce the erase discharge can be accumulated within the maximum voltage sustaining period t2.

Figure 28:
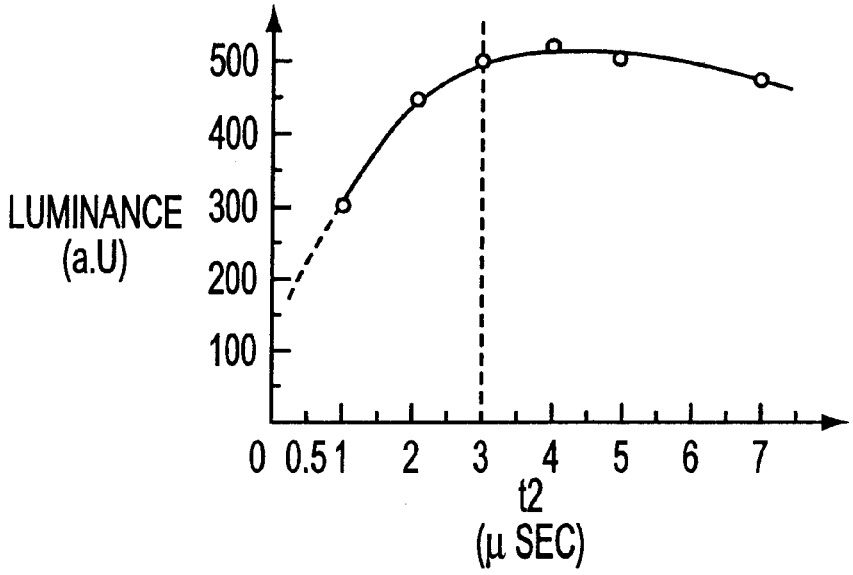
FIG. 28 is a characteristic graph for control of the display cells for explaining the method for driving the planar display panel according to Embodiment 3 of the present invention.

The reason of setting the maximum voltage sustaining period t2 as mentioned above is that, as shown in FIG. 28, discharge is not so developed and sufficient luminance cannot be obtained when the maximum voltage sustaining period t2 is short, and the discharge is stabilized when t2 is in the range not shorter than 3 $\mu$sec.

Further, a time t2+t3 from the rising of the second-step pulse to the falling of the first-step pulse, shown in FIG. 27, was set to be not longer than 10 $\mu$sec.

The reason is that, to produce the erase discharge upon the falling of the first-step pulse, not only the wall charges generated due to discharge and accumulated with the rising of the second-step pulse, but also space charges residing in the discharge gas at a high energy state are utilized, making the discharge to more easily produce.

As a result of the above-described control, the erase discharge is produced due to the wall charges and the space charges upon the falling of the first-step pulse. Because the common electrode and the individual electrode are both connected to 0 V at the time of the erase discharge, there is no difference in potential between the common electrode and the individual electrode; hence no wall charges are accumulated.

With such an phenomenon, the state of the display cell is reset to the initialized state similar to that as resulted when not subjected to display charge. In order to achieve complete initialization of wall charges, a period t4 from the falling of the composite voltage pulse to the common electrode to the next composite voltage pulse is set to be not shorter than 5 μsec. Thus, the display cell is initialized by completely eliminating the wall charges generated due to the erase discharge.

Figure 29:
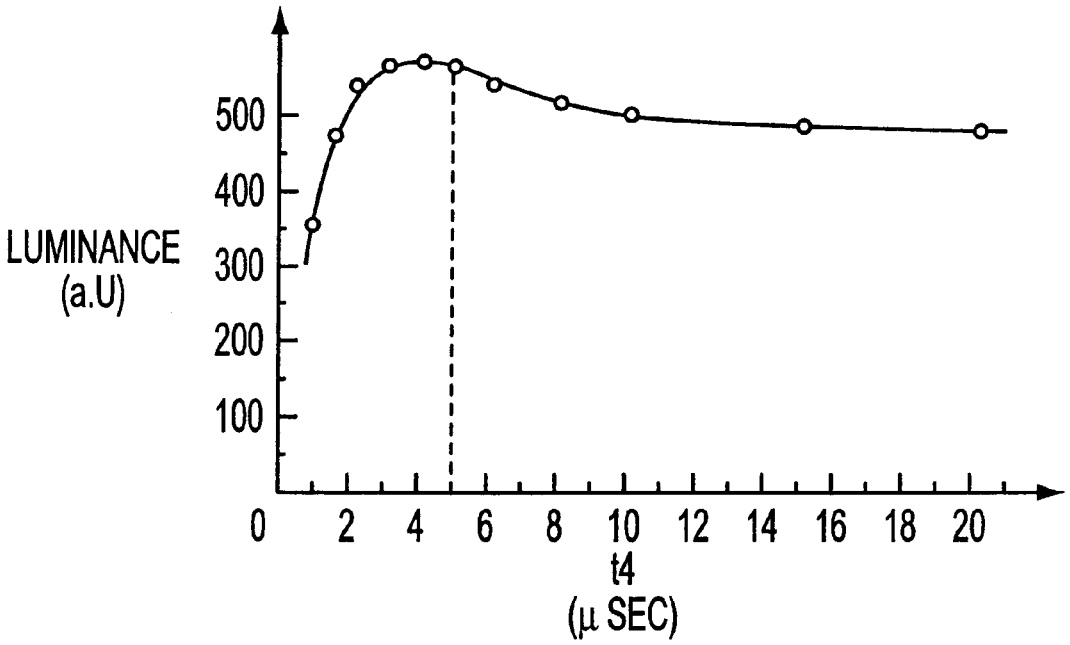
FIG. 29 is a characteristic graph for control of the display cells for explaining the method for driving the planar display panel according to Embodiment 3 of the present invention.

As shown in FIG. 29, it is seen that when the time interval (t4) between the composite voltage pulses is in a short range, the erase discharge is not produced sufficiently and the discharge is not stable with a reduction of luminance, and the discharge is stabilized when the time interval is in the range not shorter than 4–5 μsec.

Accordingly, the shape of the pulse applied to the common electrode, i.e., time allocation to the respective periods, is defined by:

$t1>1$ μsec $3$ μsec$<t2\leqq 9$ μsec $t3>1$ μsec

Additional time restrictions are provided by:

$t2+t3<10$ μsec $t4>5$ μsec

Figure 30:
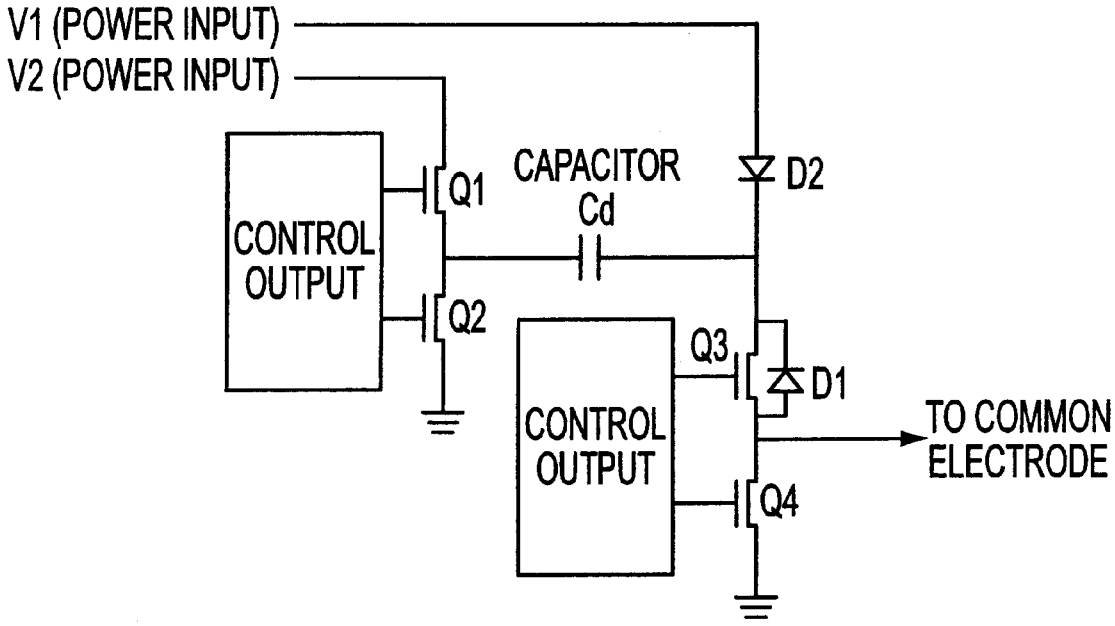
FIG. 30 is a circuit diagram of a pulse generating circuit for explaining the method for driving the planar display panel according to Embodiment 3 of the present invention.

Here, as shown in FIG. 30, the composite voltage pulse applied to the common electrode is supplied by generating the first-step pulse by a push-pull switching circuit and the second-step pulse by a charge pumping circuit.

In such a circuit arrangement, when the second-step voltage pulse is applied, charge and discharge are performed through a capacitor Cd having a sufficiently large capacity relative to the specific load capacity of the planar display panel. On the other hand, since the switching circuit on the charge pumping side drives just a parasitic capacity around the switching circuit, it is not required to have a so high withstand power as the main switching device and the size of the circuit can be miniaturized.

Also, with the circuit arrangement, most of electric charges charged into the capacity of the display panel is recovered to the driving capacitor Cd through a diode D1 connected in parallel to the main switching device 3 and the loss of the power can be minimized.

The operation of the above circuit is now explained in more detail with reference to FIG. 30.

The output voltage of the first-step pulse is controlled depending on the states of switching devices Q3, Q4. When the switching device Q4 is turned off and the switching device Q3 is turned on, the voltage V2 is applied to the common electrode. When the switching device Q3 is turned off and the switching device Q4 is turned on, the circuit is grounded and the first-step pulse has 0 V.

The second-step pulse is applied to the common electrode while its voltage is given through the capacitor Cd depending on the states of switching devices Q1, Q2.

First, when the switching device Q1 is turned off and the switching device Q2 is turned on, one terminal of the capacitor Cd is grounded to 0 V. In this condition, the capacitor Cd is charged through a diode D2 and a potential across the capacitor Cd is V2.

When the switching device Q2 is turned off and the switching device Q1 is turned on in the above condition, the one terminal of the capacitor Cd so far grounded takes a potential of V1. Looking from 0 V (ground potential), therefore, there occurs a voltage of (V1+V2) at the other terminal of the capacitor Cd. The voltage of (V1+V2) is the supplied to the common electrode through the switching device Q3.

Accordingly, by turning on/off the switching devices in accordance with the following sequence, the voltage waveform applied to the common electrode is produced as the composite voltage waveform shown in FIGS. 23 and 27:

| | Q1 | Q2 | Q3 | Q4 |
|---|---|---|---|---|
| ① at 0 V of pulse (GN) | off | on | off | on |
| ② at rising of first-step pulse | off | on | off | off |
| ③ | off | on | on | off |
| ④ at rising of second-step pulse | off | off | on | off |
| ⑤ | on | off | on | off |
| ⑥ at falling of second-step pulse | off | off | on | off |
| ⑦ | off | on | on | off |
| ⑧ at falling of first-step pulse | off | on | off | off |
| ⑨ | off | on | off | on |

Note that the first state in each transition from one condition to another intends intermediate control to prevent a penetrating current.

Further, transition states (②, ④, ⑥ and ⑧) between the successive conditions are continued for a period of about 0.5 μsec so that a penetrating current will not flow through the switching devices in push-pull connection. Pulse periods are determined by the periods of ①, ③, ⑤ and ⑦. The widths of those transition periods correspond to turning-on and turning-off times that are determined by respective switching devices (transistors or FETs) used.

By employing the above-mentioned method, it is required to add a power recovering circuit to the first-step pulse generating circuit for recovering ineffective power supplied to the capacity loads of the display cells and panel. However, electric charges supplied by the second-step pulse corresponding to a charging current for the panel capacity load is returned to the pulse generating capacitor through the body diode D1 of the switching device Q3 at the time of removal of the pulse. This results in such a merit that power consumption corresponding to the panel capacity load is avoided.

Display discharge control of the display cell is performed by applying a voltage bias to the individual electrode.

Figure 31:
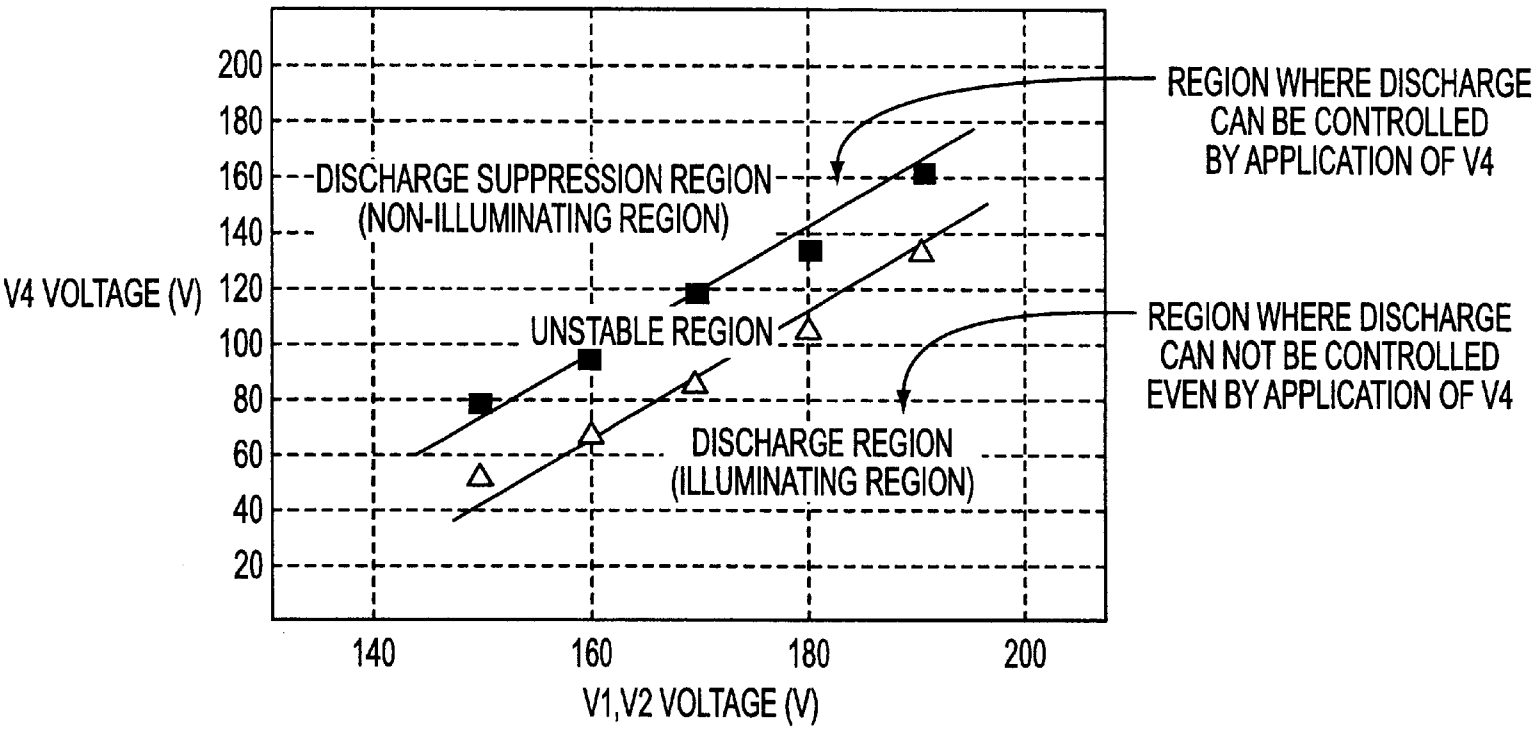
FIG. 31 is a characteristic graph for control of the display cells for explaining the method for driving the planar display panel according to Embodiment 3 of the present invention.

As shown in FIG. 31, it is found that the display cell in this embodiment has a characteristic providing a voltage region where discharge is allowed to continue and a voltage region where discharge is stopped, depending on a DC bias value V4 applied to the individual electrode which in turn depends on the crest value of the voltage pulse applied to the common electrode.

Though not shown in FIG. 31, an upper limit of the discharge suppressed region is given by the discharge starting voltage of the display panel. In the display panel of this Embodiment 3, the discharge starting voltage is about 220 V, and therefore a larger control margin is easily obtained when the composite voltage pulse applied to the common electrode is set to have a lower crest value.

Supposing that the voltages V1, V2 applied to the common electrode are each 160 V (V1+V2: 320 V), a very large control margin is provided, i.e., about 100 V in discharge suppressing control and 60 V in discharge sustaining control. By utilizing such a characteristic, display on/off control can be achieved by applying a voltage in the discharge region to the individual electrode of the display cell in which display is to be continued, and a voltage in the discharge suppression region to the individual electrode of the display cell in which display is to be erased.

With the above-described control, as seen from FIG. 23, turning-on/off of display and luminance change (gradation display) of the individual display cell can be made just by adjusting the period of a DC voltage applied to the corresponding individual electrode. Stated otherwise, luminance modulation (gradation representation) can be achieved by controlling how long period a DC voltage (V4) in the discharge suppression region is applied to mask the composite voltage pulse applied to the common electrode.

Thus, it is possible to achieve luminance modulation (gradation display) by controlling the period during which the composite voltage pulse applied to the common electrode is masked, rather than combining a plurality of luminance periods with each other for luminance modulation (gradation display). This means that the number of voltage pulses applied to the common electrode is two at maximum per one sequence. Accordingly, unlike the common electrode driven at a frequency over several tens KHz, a driving circuit having a small withstand power and being in the integrated form is usable to drive individual electrode.

Here, luminance modulation (gradation display is performed in accordance with display data input from the outside. Supposing that display is to be made with luminance gradation in 256 steps like this Embodiment 3, pulses applied to the common electrode in times about 770 are allocated to 256 overlapping periods obtained by dividing one sequence, a certain number of divided periods is selected in accordance with the input data, and the discharge suppression voltage is applied to the individual electrode corresponding to the input data during the selected periods. As a result of the above operation, the display cell can make display with the luminance corresponding to the input display data.

A luminance difference between gradation steps depends on the number of composite voltage pulses which are applied to the common electrode and contribute to emitting light from the display cell in gradation display (during the period in which the discharge suppression voltage is not applied to the individual electrode). Therefore, various gradation characteristics can be developed depending on the display input data by adjusting, among the gradation steps or the display cells, the number of composite voltage pulses which are applied to the common electrode during the period in which the discharge suppression voltage is not applied to the individual electrode.

In this Embodiment 3, three composite voltage pulses are allocated to one gradation step so that the display luminance of the input data changes in linear relation. For luminance modulation (gradation display), the individual electrode is controlled by, as described above, setting the display period as a period from the sequence head required to provide a predetermined level of luminance, and the display suppression period as a subsequent period in the second half of the sequence with intent to lower the driving frequency for the individual electrode. The driving frequency applied to the individual electrode for display is set to be the same as the sequence (frame) frequency so that driving control of the individual electrode can be performed at a very low frequency. Where the number of composite voltage pulses is, e.g., 765 for full display, the correlation among the gradation step, the number of applied pulses of discharge region voltage, and the number of applied pulses of discharge suppression region voltage is set as follows, the pulse number being counted from the pulse applied to the common electrode at the sequence head:

| Gradation (compared output of LUT) | Step Pulse of Discharge data Region Voltage | Pulse of Discharge Suppression Region |
|---|---|---|
| 0 | 0 pulse | 765 pulses |
| 1 | 3 pulses | 762 pulses |
| . | . | . |
| . | . | . |
| . | . | . |
| 254 | 762 pulses | 3 pulses |
| 255 | 765 pulses | 0 pulse |

Luminance control of the individual cells can be achieved by setting DC voltage biases in the discharge session region applied to the individual electrode responding to the number of composite voltage pulses ed to the common electrode, as listed above, in dance with the gradation step.

Further, the rising and falling of the voltage applied he individual electrode are positioned during the val between the composite voltage pulses applied to the electrode, as shown in FIG. 23. The reason is that because a discharge phenomenon generated upon the composite voltage pulse being applied to the common electrode is completed within the period of one composite voltage pulse, if discharge control is performed during the period of one composite voltage pulse, the control would come to an end while the discharge produced by the composite voltage pulse is not yet completed.

The spacing between the rising or falling of the voltage applied to the individual electrode and the composite voltage pulse is affected by a time characteristic of the discharge produced in the display cell. In this Embodiment 3, the erase discharge is settled in about 5 $\mu$sec, and control of the voltage applied to the individual electrode should be made after the settlement of the erase discharge. Thus, time spacings t5, t6 between the rising and falling of the voltage applied to the individual electrode and the composite voltage pulse are required to meet t5>5 $\mu$sec and t6>0.5 $\mu$sec, respectively.

Also, if control of the voltage applied to the individual electrode is in synch with the rising of the composite voltage pulse applied to the common electrode, discharge would be produced upon the rising of the first-step pulse. A sufficient time spacing should be given between the rising of the voltage applied to the individual electrode and the rising of the composite voltage pulse in allocation of control time over the sequence.

In this Embodiment 3, based on the above-mentioned setting related to the number of voltage pulses applied to the common electrode and the time definition for the pulse shape, values of the time parameters of the pulse applied to the common electrode were set to;

t1: 2 $\mu$sec t2: 5 $\mu$sec t3: 2 $\mu$sec t4: 11 $\mu$sec (25 $\mu$sec in the initializing sequence)

t5: 6 $\mu$sec (10 $\mu$sec in the initializing sequence, until the rising of the voltage pulse applied to the individual electrode)

t6: 5 $\mu$sec (5 $\mu$sec in the initializing sequence, until the falling of the voltage pulse applied to the individual electrode)

and the average frequency of the composite voltage pulses applied to the common electrode was set to about 46 KHz.

Further, to carry out the gradation representation, the individual electrode is controlled as follows.

Figure 32:
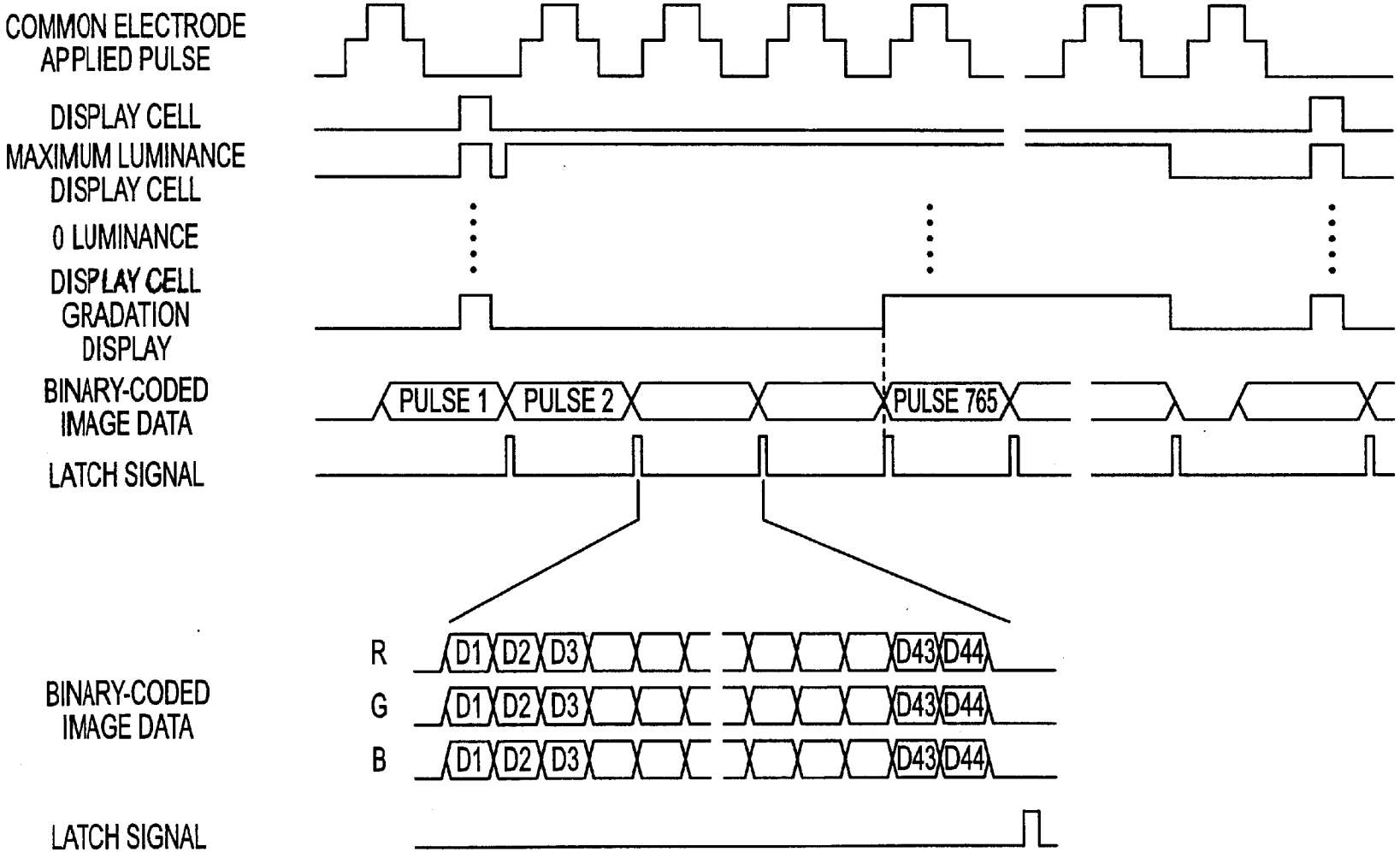
FIG. 32 is a timing chart for control of gradation display for explaining the method for driving the planar display panel according to Embodiment 3 of the present invention.

As seen from the block diagram of gradation display control shown in FIG. 20A and a timing chart of the respective pulses shown in FIG. 32, input image data is stored in the image memory in the number of pixels necessary for display, and the stored data is read in accordance with the display sequence. The data in the image memory is transferred to individual output control portions of the driving circuit for driving the individual electrodes in accordance with the position information of the display cells.

The image data is transferred through the following steps.

1). The image data stored in the image memory is read out of the memory in sequence corresponding to the pixel positions of output destinations in the driving circuit.

2). The read data is compared with the data obtained by converting the counted number of voltage pulses applied to the common electrode using the LUT (look-up table). If the image data is equal to or greater than the compared data, then the image data is set to "L" data. If the image data is smaller than the compared data, then the image data is set to "H" data.

3). The image data binary-coded in the above 2) is transferred to a driving circuit IC of the individual electrode.

The above-mentioned steps are repeated for each pulse prior to application of the voltage pulse applied to the common electrode. The binary-coded data transferred to the driving circuit IC is output in response to a latch signal and is retained in the output state until a next latch signal. Also, the timing at which the voltage is applied to the individual electrode is controlled in accordance with the timing of the latch signal.

Then, the driver IC of the individual electrode determines an output voltage value in accordance with the binary-coded image data such that a voltage in the discharge sustaining region is output for the output of the image data set to "L", and a voltage in the discharge suppression region is output for the output of the image data set to "H".

As shown in an waveform example of FIG. 23, since the data obtained from the LUT at this time is resulted by being converted to a value based on the number of composite voltage pulses applied to the common electrode and counted from the sequence head and by being binary-coded after comparison with the image data, a voltage in the discharge sustaining region is output all over one sequence when the image data has a value of 255 (maximum luminance), and a voltage in the discharge suppression region is output all over one sequence when the image data has a value of 0.

In this Embodiment 3, the voltage in the discharge sustaining region was applied as an output of 0 V and the voltage in the discharge suppression region was applied as an output of 160 V.

With the above-described control, for each pulse applied to the common electrode, the image data is always compared with the number of pulses applied to the common electrode, and the period in which the discharge is to be sustained or suppressed is determined. As a result, display luminance in one sequence is variable in units of a voltage pulse applied to the common electrode, and a phenomenon that discharge sustaining regions are discontinuous in point of time and luminance information interferes with each other between sequences is avoided. Furthermore, since the individual electrode is subjected to switching at maximum twice, i.e., at the time of initialization and of display control, a driver IC for PDP (Plasma Display Panel) can be used to drive the individual electrode, resulting in a great improvement in points of cost, mounting and reliability.

Embodiment 4

In the above-described Embodiment 3, the composite voltage pulse for initializing the display cell is inserted for each sequence (display frame). That initializing sequence however produces discharge luminescence and causes a lowering of light/dark contrast. In view of the above, the initializing pulse may be inserted once in units of several frames. This enables display to be achieved with a high light/dark contrast without deteriorating stability of display.

Embodiment 5

In the above-described Embodiment 3, discharge is controlled by the switching operation using the crest value of the voltage 0 V or (discharge suppression voltage) applied to the individual electrode. However, the voltage applied to the individual electrode or display control is not necessarily set to 0 V in the display period. By setting ;that voltage to a level as high as possible within the discharge region, a voltage difference required for the switching operation in display control is reduced and a driving circuit for lower voltage can be used. Where the first-step pulse and the second-step pulse constituting the composite voltage pulse applied to the common electrode are each set to have a voltage crest value of 160 V, for example, display control can be executed by applying the voltage applied to the individual electrode at a level of 50 V in the display period and 100 V in the non-display period.

In this case, the display panel can be operated by a driving circuit having a withstand voltage which is about ⅓ of that required for the operation according to Embodiment 3. Consequently, improvements in reliability and cost are resulted.

Embodiment 6

In the above-described Embodiment 3, during the initializing sequence, pulses are applied to all the individual electrodes subsequent to application of the composite voltage pulse to the common electrode. For the purpose of stabilizing the display cell, however, the composite voltage pulse may be applied to the common electrode after application of the pulses to the individual electrodes. In this case, the composite voltage pulse for initialization can be counted as the first pulse for display discharge, and therefore a higher light/dark contrast can be achieved more easily than the case of inserting a separate composite voltage pulse for the initializing sequence.

Embodiment 7

In the above-described Embodiment 3, the discharge suppression period is set in linear relation with respect to the input data for gradation display. However, the discharge suppression period is not necessarily allocated in linear relation, and luminance modulation may be performed corresponding to the γvalue in conformity with the video signal standards for TV signals, etc. Where the number of pulses applied to the common electrode for the input data (265-gradation display) is 765, for example, the individual electrode is held in the discharge region for a period corresponding to the number of composite voltage pulses (i.e., an effective period of the composite voltage pulses) calculated by the following formula, and a voltage in the discharge suppression region is applied to the individual electrode for a period corresponding to the number resulted from (765−(number of composite voltage pulses)):

$$\text{number of composite voltage pulses (biases in the discharge region)} = \text{INT}(765 \times (\text{input data}/255)1/\gamma)$$

By employing the above method, the need of externally executing inverse γ-conversion for compatibility with the display device is eliminated, and high-quality display can be achieved without a complex computing process.

Also, the number of pulses applied to the common electrode during one sequence is not always set to 765, but may be set to any suitable number so long as it is not less than the number capable of providing gradation steps required for realizing the desired gradation display. When the selected number is not larger than the maximum frequency of the composite voltage pulses, the period of gradation control can be calculated by replacing 765 in the above formula with the selected number. By using the calculated value as an input to the LUT, desired gradation display can be achieved.

Further, while Embodiment 3 is designed to allocate the display period preceding the non-display period in one sequence for gradation display, the order of the display period and the non-display period may be reversed.

As described above, with the methods for driving the planar display panel according to Embodiments 3 to 7, since discharge produced by applying one composite voltage pulse to the common electrode functions to not only start the discharge, but also initialize the display cell with erase discharge, a large control margin can be set for the display operation. Further, by applying the display initializing pulses to all the individual electrodes at constant intervals, even when discharge produced upon driving of the common electrode becomes unstable, display can be maintained in a stable state, thus resulting in very stable display.

Also, since the common electrode has a function of sustaining discharge, all the display cells can be driven at a time, and display control can be performed by driving the individual electrodes at a lower frequency, the circuit configuration is simplified. In other words, circuits requiring large power can be concentrated on a section for driving the common electrode, while the individual electrodes can be driven by circuits operating at a lower voltage and lower power consumption. As a result, an inexpensive and highly-reliable planar display panel can be manufactured.

Additionally, since gradation display is realized by setting a continuous display period in one sequence, a planar display panel capable of presenting gradation display with high quality can be achieved.

INDUSTRTAL APPLICABILITY

According to the planar display panel, the panel manufacturing method, the panel controller, and the panel driving method of the present invention, as described above, there is provided a planar display panel which has an electrode structure capable of individually driving display cells of the display panel on the cell-by-cell basis and reducing the thickness of the planar panel. In addition, gradation control can be achieved by performing switching control for each of individual electrodes provided independently of one another in one-to-one relation to the display cells. Further, there is provided a planar display panel which can set a large control margin in the display operation, ensure stable display, and present gradation display with high reliability and quality.

What is claimed is:

1. A method for driving a planar display panel in which a pair of a common electrode driven in common and an individual electrode driven individually are provided side by side for each of a plurality of cells, and a voltage pulse is applied to said common electrode to produce luminescence due to discharge on a dielectric layer formed over said common electrode and said individual electrode, said method comprising the steps of:

applying a voltage pulse to said individual electrode to reverse the polarity of wall charges accumulated on said dielectric layer, and then applying a voltage pulse to said common electrode so that an electric field of the wall charges caused upon the reversal of the polarity is additionally applied.

2. A method for driving a planar display panel according to claim 1, wherein assuming that one sequence is defined by a certain number of voltage pulses applied to said common electrode, said voltage pulse is applied to said individual electrode in units of one or plural sequences.

3. A method for driving a planar display panel according to claim 1, wherein the voltage pulse applied to said common electrode functions to start discharge at rising of the voltage pulse as a result of addition of the electric field of said wall charges caused upon the reversal of the polarity, and to produce erase discharge at falling of the voltage pulse with wall charges caused by the started discharge.

4. A method for driving a planar display panel according to claim 3, wherein the voltage pulse applied to said common electrode is a composite voltage pulse comprising a first voltage pulse not higher than the discharge starting voltage and a second voltage pulse superposed within a period of said first voltage pulse, said composite voltage pulse having a voltage value not less than the discharge starting voltage.

5. A method for driving a planar display panel according to claim 4, wherein erase discharge is produced due to said wall charges at falling of said first voltage pulse.

6. A method for driving a planar display panel according to claim 5, further comprising the step of applying the voltage pulse to said individual electrode to stop the discharge after erase discharge has been produced by said composite voltage pulse applied to said common electrode.

7. A method for driving a planar display panel according to claim 1, wherein when the voltage pulse is applied to said common electrode to produce discharge, a voltage in a discharge sustaining region is applied to the individual electrode of the display cell in which the discharge is to be sustained, and a voltage in a discharge suppression region is applied to the individual electrode of the display cell in which the discharge is to be stopped.

8. A method for driving a planar display panel according to claim 2, wherein assuming that one sequence is defined by a certain number of voltage pulses applied to said common electrode, gradation display is made by applying a voltage in a discharge sustaining region enough to sustain the discharge to the individual electrode corresponding to the number of voltage pulses in one part of one sequence, thereby providing a display sustaining period, and by applying a voltage in a discharge suppression region to stop the discharge to the individual electrode corresponding to the number of voltage pulses in the other part of one sequence, thereby providing a display suppression period.

9. A method for driving a planar display panel according to claim 8, wherein the front half of one sequence provides said display sustaining period and the second half of one sequence provides said display suppression period.

10. A method for driving a planar display panel according to claim 8, wherein the certain number of voltage pulses applied to said common electrode within one sequence is selected to be not less than the number of gradation steps, and a plural number of voltage pulses are assigned to one gradation step.

* * * * *